United States Patent [19]

Taguchi et al.

[11] 4,174,220

[45] Nov. 13, 1979

[54] COLOR PHOTOGRAPHIC MATERIALS CONTAINING DYE FADING INHIBITORS

[75] Inventors: Masahiko Taguchi; Katsuo Mogaki; Syun Takada, all of Odawara, Japan

[73] Assignee: Konishiroku Photo Industry Co., Ltd., Tokyo, Japan

[21] Appl. No.: 846,127

[22] Filed: Oct. 27, 1977

[30] Foreign Application Priority Data

Oct. 30, 1976 [JP] Japan ..... 51-130742

[51] Int. Cl.[2] ..... G03C 1/76; G03C 1/06; G03C 1/40

[52] U.S. Cl. ..... 430/613; 430/551

[58] Field of Search ..... 96/95, 56, 74, 100

[56] References Cited

U.S. PATENT DOCUMENTS

| | | | |
|---|---|---|---|
| 2,735,765 | 2/1956 | Loria et al. | 96/56 |
| 3,432,300 | 3/1969 | Lestina et al. | 96/74 |
| 3,700,455 | 10/1972 | Ishikawa et al. | 96/56 |
| 3,764,337 | 10/1973 | Arai et al. | 96/84 |
| 3,930,866 | 1/1976 | Oishi et al. | 96/95 |
| 4,015,990 | 4/1977 | Ishida et al. | 96/84 UV |

*Primary Examiner*—Travis Brown

*Attorney, Agent, or Firm*—Bierman & Bierman

[57] ABSTRACT

A color photosensitive material is disclosed which contains a support and a silver halide photosensitive layer wherein the photosensitive material also contains a combination of a member selected from one group of compounds with a member selected from another group of compounds.

21 Claims, No Drawings

COLOR PHOTOGRAPHIC MATERIALS CONTAINING DYE FADING INHIBITORS

This invention relates to color photographic materials and particularly to silver halide color photographic materials in which unexposed areas and dye image portions obtained by processing the color photographic materials are prevented from discoloration and fading due to light.

It is well known to obtain color images by developing imagewise exposed silver halide particles of silver halide color photographic materials with aromatic primary amine compounds, and by forming dye images by reaction of the resulting oxidation products with couplers.

In order to form cyan, magenta and yellow dye images in the above-mentioned process, there are usually used phenol or naphthol type couplers, 5-pyrazolone, pyrazolinoimidazole, pyrazolotriazole, indazolone or cyanoacetyl type couplers, and acylacetamide or benzoylmethane type coupler, respectively.

It is desired that the dye image thus obtained are not subject to discoloration and fading even when exposed to light and stored at an elevated temperature and humidity for a long period of time. It is well known that fastness of such dye images mainly to an ultraviolet ray or visible light are not yet found to be satisfactory and the dye images are readily subject to discoloration and fading when they are irradiated with actinic rays. In order to eliminate such drawbacks as mentioned above, there have heretofore been proposed processes using various selected couplers believed to be less in fading property, using ultraviolet absorbers to protect dye images from ultraviolet ray or using fading inhibitors to prevent fading due to light.

For instance, there have heretofore been proposed various processes in which ultraviolet absorbers are incorporated and mixed into color photographic materials to improve the resulting dye images in fastness to light. In order to impart satisfactory light fastness to the dye images by the use of ultraviolet absorbers, however, a relatively large amount is required. In this case, because of coloration of the ultraviolet absorber, per se, the resulting dye image was often markedly stained. Further, even when the ultraviolet absorber was used, no effect was exhibited in preventing the resulting dye image from fading and thus there was a limit to improve light fastness by use of ultraviolet absorbers. Furthermore, there has been proposed the use of fading inhibitors having phenolic hydroxyl groups or such groups as forming the phenolic hydroxyl groups on hydrolysis, for example, bisphenols in Japanese Patent Publication Nos. 31256/1973 and 31625/1973, pyrogallol, gallic acid and esters thereof in U.S. Pat. No. 3,069,262, α-tocopherols and acyl derivatives thereof in U.S. Pat. No. 2,360,290 and Japanese Laid-Open-to-Public Patent Publication No. 27333/1976, 6-hydroxychromans in U.S. Pat. Nos. 3,432,300 and 3,574,627, 5-hydroxycoumaran derivatives in U.S. Pat. No. 3,573,050, and 6,6'-dihydroxy-2,2'-bisspirochromans.

The above-mentioned compounds certainly exhibit their effects on light fastness of dyes, but their effect is not sufficient, and the fading inhibition effect thereof suddenly is reduced or diminishes at a certain point of time during strage of the resulting color photographic materials, or the so-called yellow stain (hereinafter called "Y-stain") due to ultraviolet rays takes place where unreacted coupler remains, i.e. unexposed area.

Certain kinds of these compounds, moreover, are relatively excellent in fading inhibition effects on dye images obtained from magenta couplers, but have no fading inhibition effect on dye images obtained from yellow and cyan couplers, or inversely even accelerate fading of dye images sometimes, and thus it is an actual state that these compounds are not found yet to be satisfactory.

An object of the present invention is to provide color photographic materials containing such fading inhibitors as having excellent fading inhibition effects and Y-stain prevention effects; being excellent in solubility in high boiling point solvents, dispersion stability and anti-diffusion property; and bringing no hinderance to color-developability of couplers.

As the result of an extensive study, the present inventor had found that the above-mentioned object can be accomplished by the use of color photographic materials comprising at least one of the compounds represented by the following general formula [I] in combination with at least one of the compounds represented by general formula [II] set forth later (hereinafter called "the present compounds").

General formula [I]

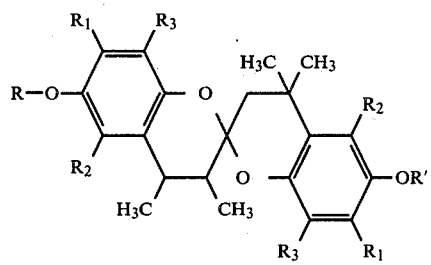

In the formula [I]; $R_1$ represents an alkyl group (e.g. methyl, ethyl, n-propyl, i-propyl, n-butyl, i-amyl, n-octyl, sec-octyl, t-octyl, n-dodecyl or n-octadecyl), an alkenyl group (e.g. allyl, octenyl or oreyl), an aryl group (e.g. phenyl or naphthyl), an alkoxy group (e.g. methoxyl, ethoxyl or butoxyl), an alkenoxyl group (e.g. allyloxyl) or an aryloxyl group (e.g. phenyloxyl); $R_2$ and $R_3$ individually represent hydrogen, halogen (e.g. fluorine, chlorine or bromine), an alkyl group (e.g. methyl, ethyl, n-propyl, i-propyl, n-butyl, t-butyl, n-octyl or n-dodecyl), an alkenyl group (e.g. allyl or octenyl) or an alkoxyl group (e.g. methoxyl, ethoxyl, butoxyl or dodecyloxyl); R represents an alkyl group (e.g. methyl, ethyl, n-propyl, i-propyl, n-butyl, t-butyl, n-amyl, i-amyl, n-octyl, n-dodecyl or n-octadecyl), an alkenyl group (e.g. allyl, octenyl or oleyl), a cycloalkyl group (e.g. cyclohexyl), an aryl group (e.g. phenyl), a heterocyclic group (e.g. imidazolyl, furyl, pyridyl or thiazolyl), $R_6CO$—, $R_7SO_2$— or $R_8NHCO$—; R' is hydrogen, $R_6CO$—, $R_7SO_2$— or $R_8NHCO$—; $R_6$, $R_7$ and $R_8$ individually represent an alkyl group (e.g. methyl, ethyl, n-propyl, i-propyl, n-butyl, t-butyl, n-octyl or n-dodecyl), an alkenyl group (e.g. allyl, octenyl or octadecenyl), a cycloalkyl group (e.g. cyclopentyl or cyclohexyl), an aryl group (e.g. phenyl, tolyl, or butylphenyl) or a heterocyclic group (e.g. imidazolyl, furyl, pyridyl or thiazolyl); and, the respective above-mentioned groups such as the alkyl group, the alkenyl group, the aryl group, the alkoxy group, the alkenoxy group, the aryloxy group, the cycloalkyl group and the heterocyclic group, include the substituted of which a substituent is such as halogen (e.g. chlorine or bromine), an alkyl group (e.g. methyl, ethyl, n-propyl, i-propyl, n-butyl, t-butyl, t-octyl or n-dodecyl), an aryl group (e.g. phenyl), an aryloxyl group, a cyano group, a acyloxyl group, a carboalkoxyl group, an acyl group, a sulfamoyl group, hydroxyl, nitro or an amino group. Further, the groups for said substituent include the further substituted of which substituent is appropriately selected from those as mentioned above. And further, when R′ represents $R_6CO$—, $R_7SO$— or $R_8NHCO$—, R may be either the same with R′ or different from R′. Furthermore, in the general formula [I], the compounds of the following formula [Ia] are included.

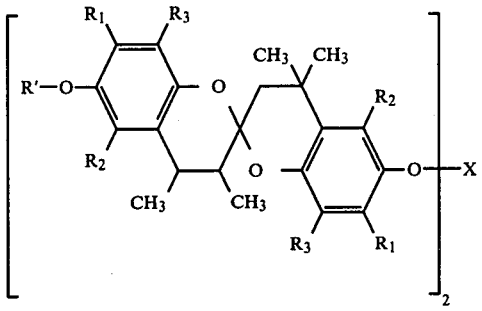

In the formula [Ia]: R′, $R_1$, $R_2$ and $R_3$ individually represent as defined in formula [I] and X represents an alkylene group which includes alkylene, substituted alkylene and alkylene which contains in the carbon chain such as intermediate as —O—, —S—, —NB— (B is e.g. hydrogen, a lower alkyl group or an aryl group such as phenyl), $—SO_2—$ or an arylene group such as phenylene, or such group as $$—\overset{O}{\overset{\|}{C}}—X'—\overset{O}{\overset{\|}{C}}—,$$

-continued $$—SO_2—X'—SO_2—, \text{ or } —CONH—X'—NHCO—$$

[In these formulae, X′ represents an arylene group such as phenylene or an alkylene group which includes alkylene which contains, in the carbon chain, such an intermediate as —O—, —S—, —NB— (B is as defined above) or $—SO_2—$].

Further, the compounds, having general formulae [I] and [Ia] wherein $R_1$ has an alkyl, alkenyl or aryl group which includes the substituted or unsubstituted and $R_2$ and $R_3$ individually have hydrogen or an alkyl group including the substituted or the unsubstituted (Herein, the substituent for the substituted is such as mentioned above), are preferred.

Furthermore, particularly useful are those compounds of formulae [I] or [Ia] wherein $R_1$ has an alkyl group or an aryl grup, such as phenyl, which aryl group includes aryl substituted with an alkyl group; $R_2$ and $R_3$ each having hydrogen; R having an alkyl, alkenyl, cycloalkyl, $R_6$—CO—, $R_7SO_2$— or $R_8NHCO$— group which includes the substituted of which substituent is phenyl or carboalkoxyl; $R_6$, $R_7$ and $R_8$ each having an alkyl group or an aryl group, such as phenyl, which includes the substituted of which substituent is an alkyl group; and X having an alkylene group or $$—\overset{O}{\overset{\|}{C}}—X'—\overset{O}{\overset{\|}{C}}—$$

(Herein, X′ represents an alkylene group).

In formulae [I] and [Ia], all the alkyl or alkenyl group are preferably of 1-32 carbon atoms. Especially the alkyl group for R in formula [I] and $R_6$ in formulae [I] and [Ia] are more preferably of 1-18 carbon atoms, most preferably of 1-8 carbon atoms.

Typical examples of these compounds are exemplified below, but the compounds used in the present invention are not limited thereby. Exemplified compound:

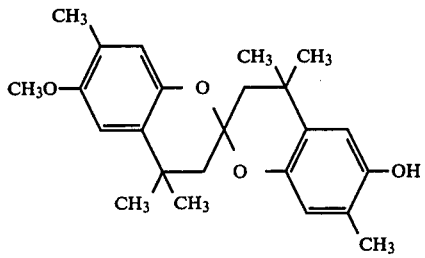

(1)

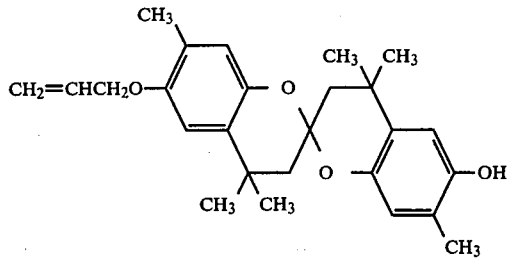

(2)

-continued
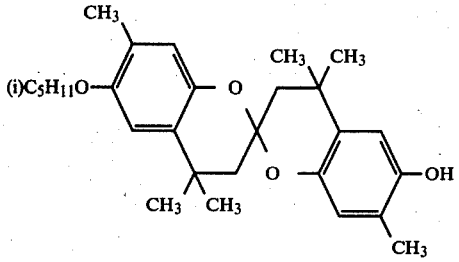
(3)
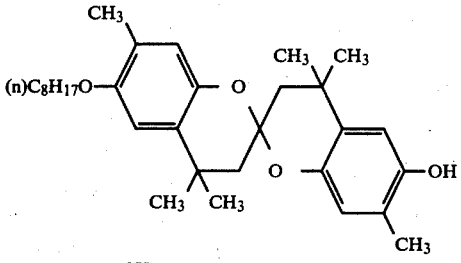
(4)
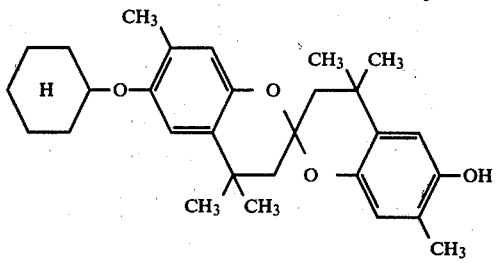
(5)
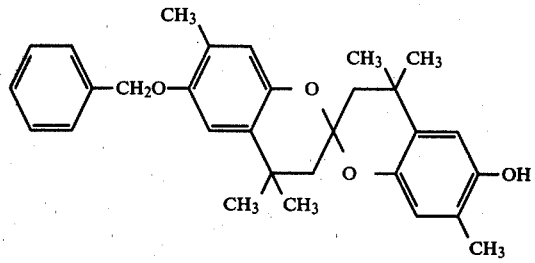
(6)
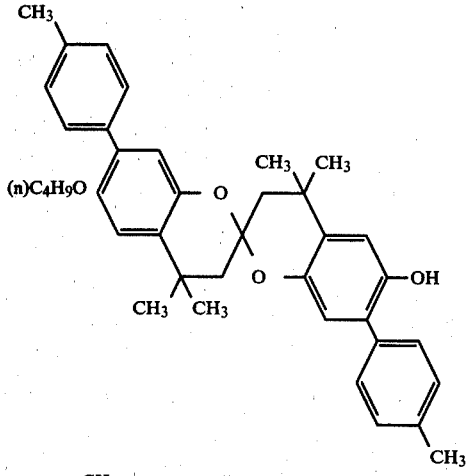
(7)
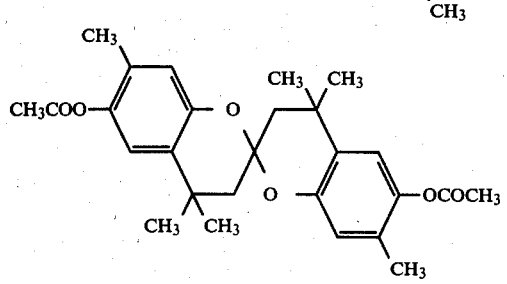
(8)

-continued
(9)
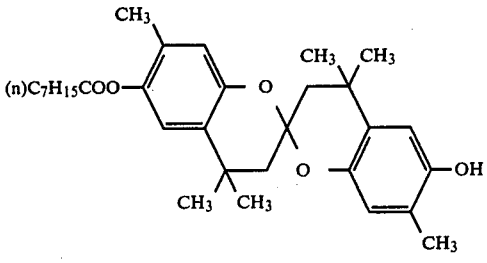
(10)
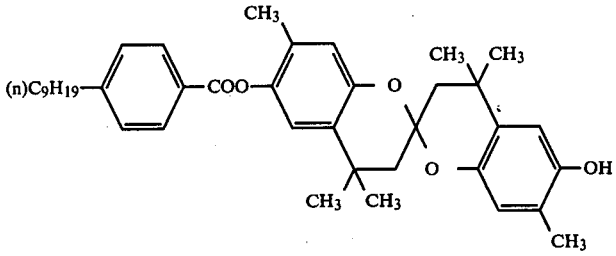
(11)
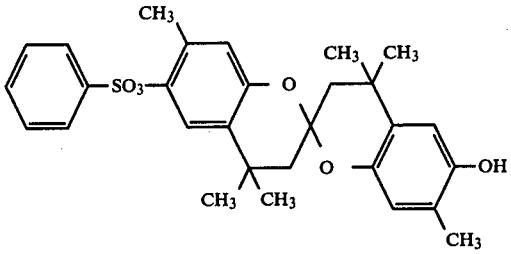
(12)
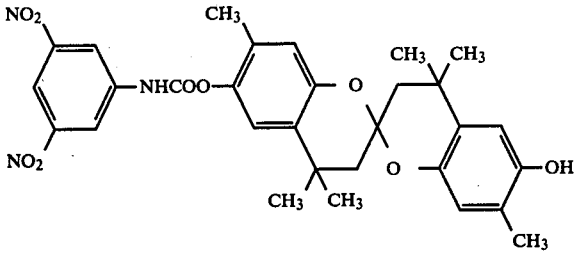
(13)
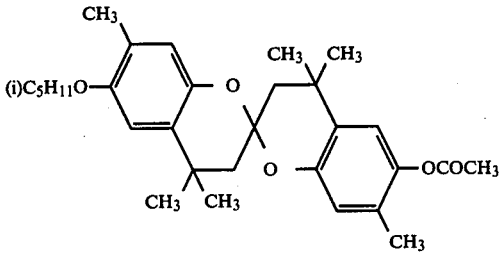
(14)
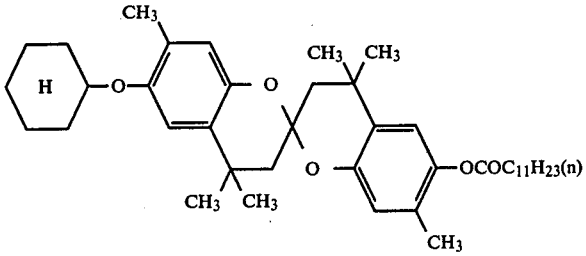

-continued
(15)
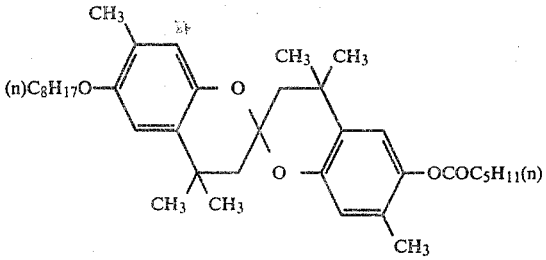
(16)
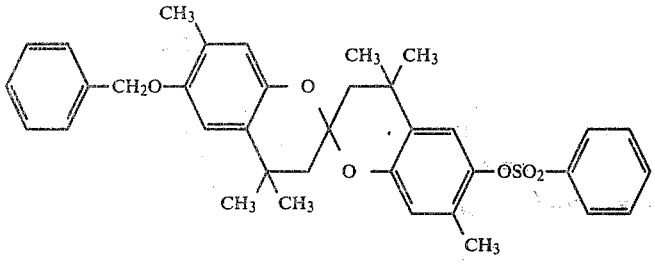
(17)
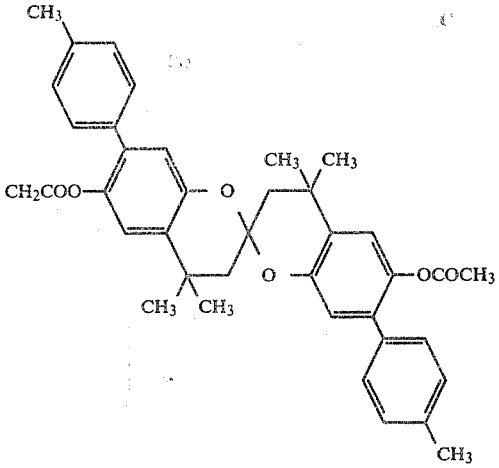
(18)
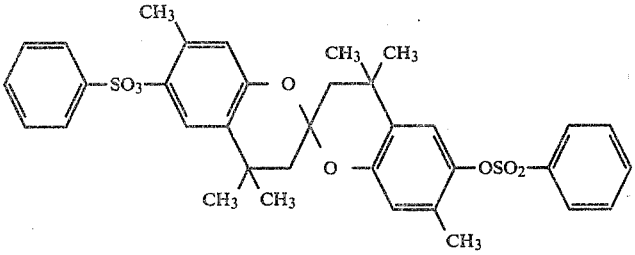
(19)
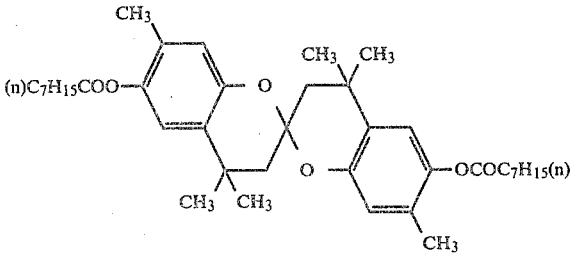
(20)
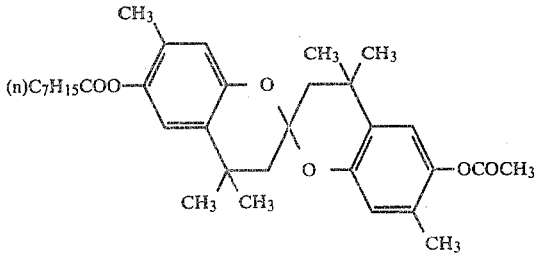

-continued
(21)
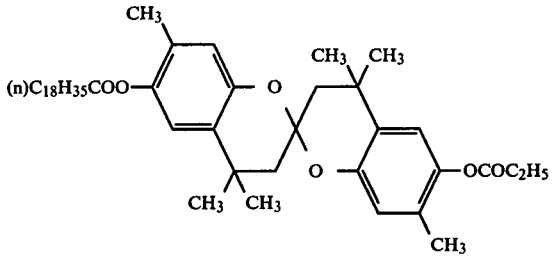
(22)
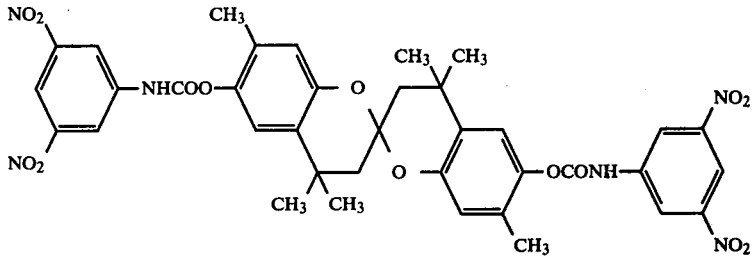
(23)
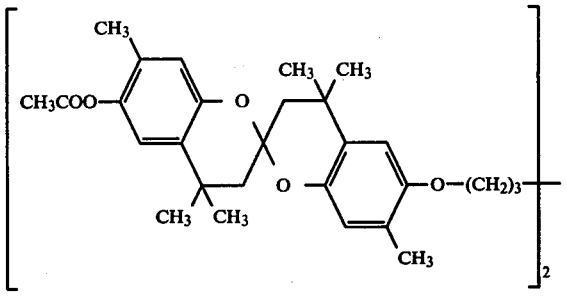
(24)
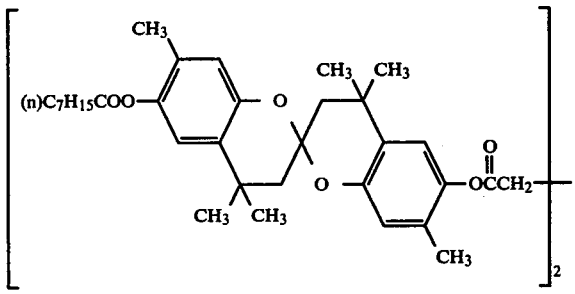
(25)
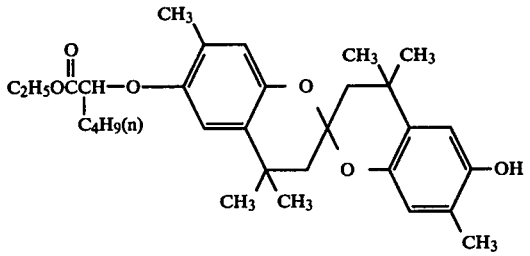
(26)
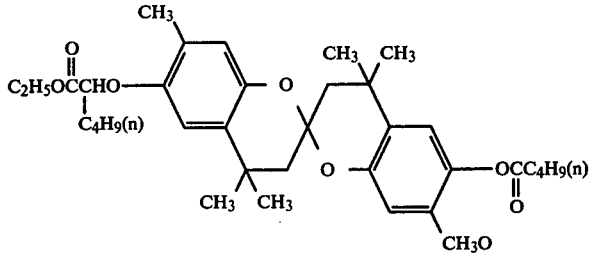

-continued (27)

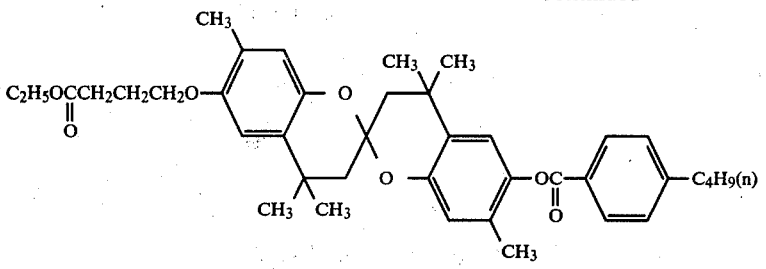

(28)

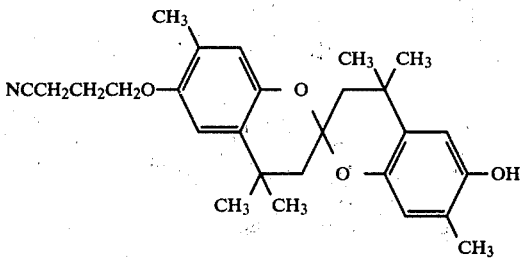

General formula (II)

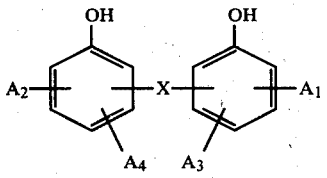

wherein $A_1$, $A_2$, $A_3$ and $A_4$ are individually an alkyl group of 1 to 18 carbon atoms; the total carbon atoms of $A_1$, $A_2$, $A_3$ and $A_4$ being not more than 32; X is a simple bond, oxygen, sulfur, sulfonyl or

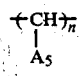

in which $A_5$ represents hydrogen or an alkyl group of 1 to 10 carbon atoms; and n is an integer of 1 to 3.

As the alkyl group of the compounds represented by the aforementioned general formula [II], there may be mentioned any of those either straight chained or branched, for example, methyl, ethyl, n-propyl, i-propyl, n-butyl, i-butyl, sec-butyl, t-butyl, n-amyl, t-amyl, t-hexyl, n-octyl, t-octyl, decyl, n-dodecyl, t-dodecyl, n-octadecyl, t-octadecyl, etc. As the group represented by

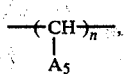

there may be, for example, methylene, ethylene, trimethylene, propylene, isobutylene, ethylidene propylidene, butylidene, isobutylidene, hexylidene, heptylidene, octylidene, etc.

Of the compounds represented by the aforementioned general formula [II], those which are useful for the present invention include compounds represented by the following general formula [IIa] or [IIb].

General formula (IIa)

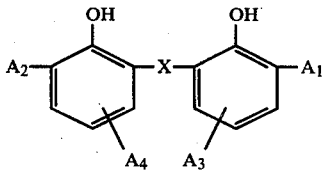

General formula (IIb)

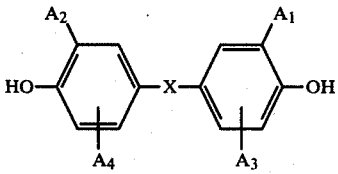

In the general formulas [IIa] and [IIb], $A_1$, $A_2$, $A_3$, $A_4$ and X are respectively as defined in the general formula (II), and the compounds of general formula [IIa] or [IIb], in which at least one of $A_1$ and $A_2$ is a tertiary alkyl group, are particularly useful.

Typical examples of the compound represented by the aforementioned general formula [II] are exemplified below, but the compounds used in the present invention are not limited thereto.

(29)

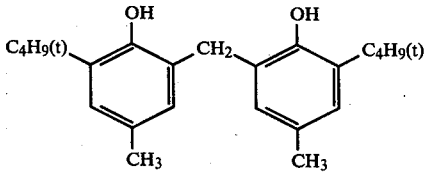

-continued
(30)
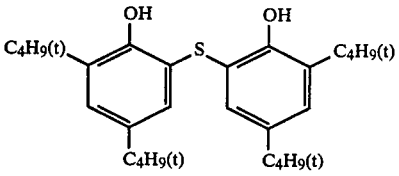
(31)
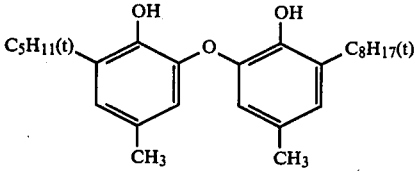
(32)
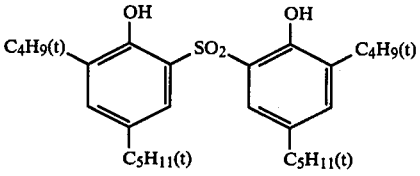
(33)
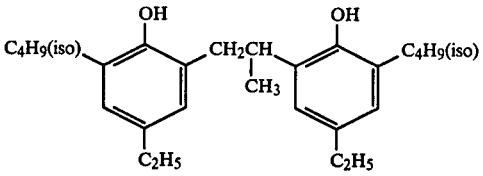
(34)
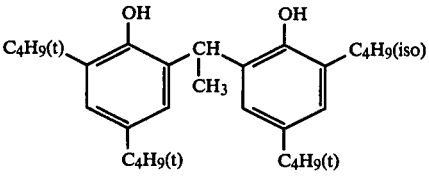
(35)
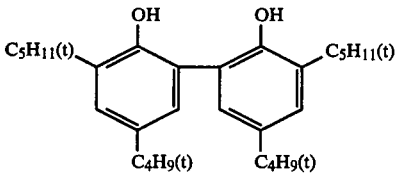
(36)
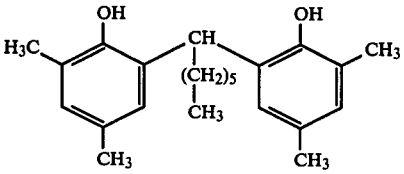
(37)
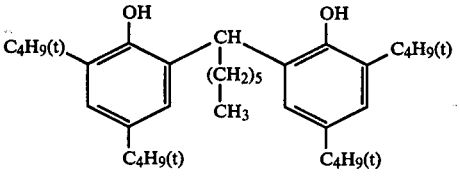
(38)
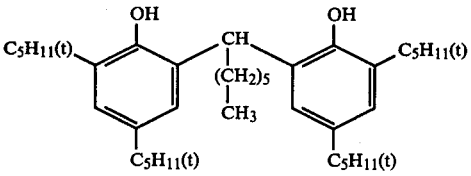
(39)
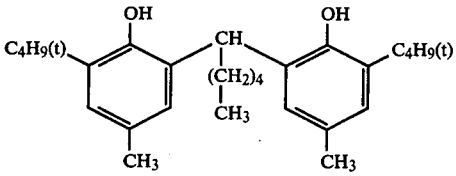
-continued
(40)
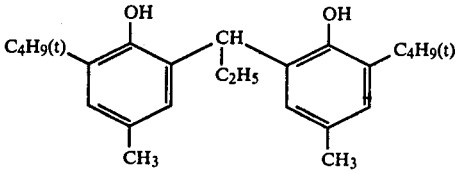
(41)
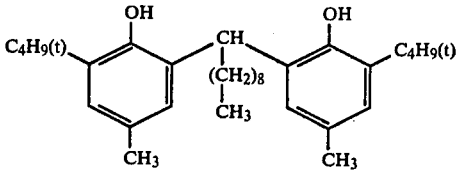
(42)
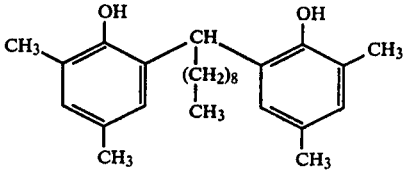
(43)
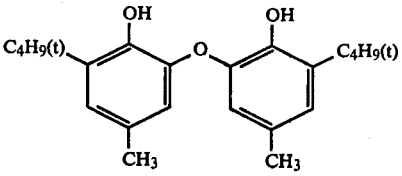
(44)
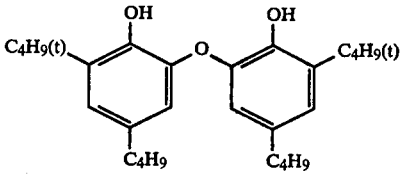
(45)
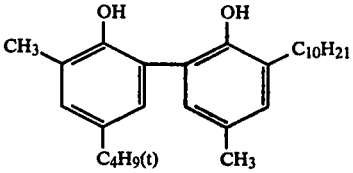
(46)
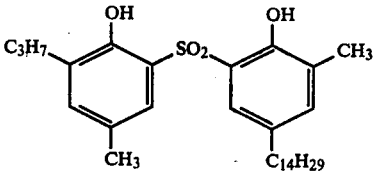
(47)
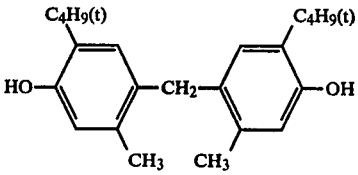
(48)
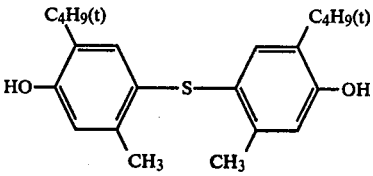
(49)
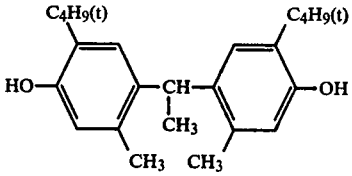

-continued (50)

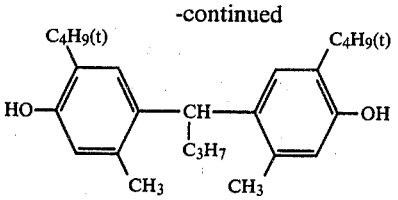

(51)

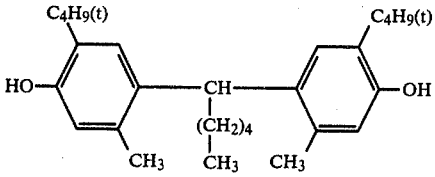

(52)

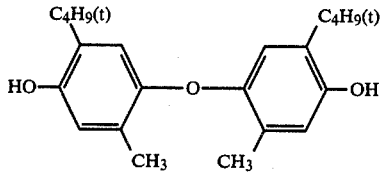

(53)

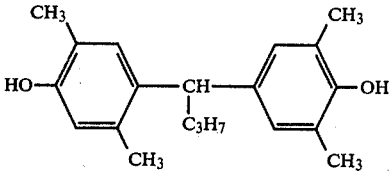

(54)

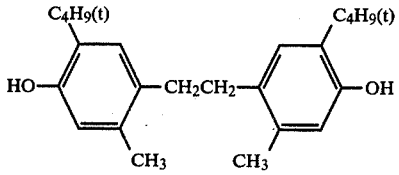

(55)

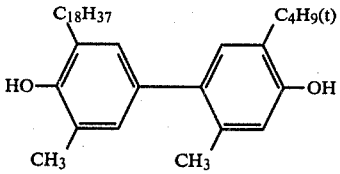

(56)

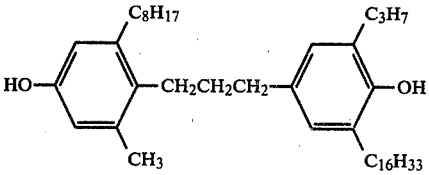

(57)

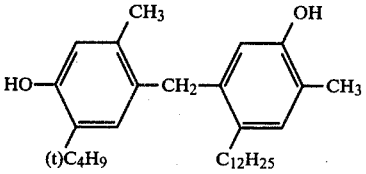

(58)

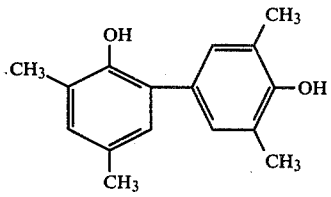

(59)

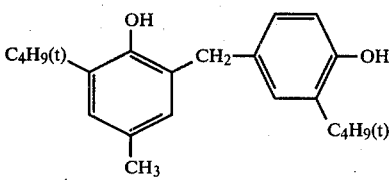

-continued (60)

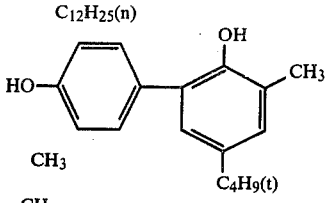

(61)

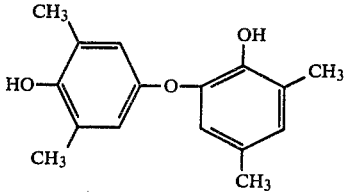

(62)

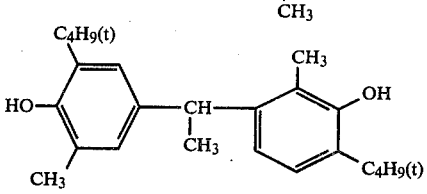

The compounds represented by the aforementioned general formula [I] can be synthesized by subjecting a 6,6′-dihydroxy-4,4,4,′,4′-tetramethyl-bis-2,2′-spirochroman compound obtained by a process disclosed in U.S. Pat. No. 3,764,337 to alkylation or acylation according to an ordinary procedure.

The compounds represented by the aforementioned general formula [II] can be synthesized according to processes disclosed in U.S. Pat. Nos. 2,792,428, 2,796,445 and 2,841,619, and Journal of the Chemical Society, p. 243 (1954).

The aforesaid effects of the present invention such as excellent fading inhibition effect, Y-stain prevention effect and solubility in solvent obtained by the combination use of the present compounds are synergistic effects which cannot be obtained when the present compounds are used singly.

The present compounds are preferably incorporated into a silver halide emulsion layer, but may be added to other layers, for example, a layer adjacent to the silver halide emulsion layer.

The present compound are oil-soluble and, in general, they are incorporated into a silver halide emulsion, according to procedures disclosed in U.S. Pat. Nos. 2,322,027, 2,801,170, 2,801,171, 2,272,191 and 2,304,940, by dissolving them together with couplers in a high boiling point solvent, if necessary in combination with a low boiling point solvent, and dispersing the resulting mixture to prepare a dispersion which is then incorporated into the silver halide emulsion. In this case, the present compounds may be used without any difficulty in combination with hydroquinone derivatives, ultraviolet absorbers or known fading inhibitors.

More concretely, the present compounds are incorporated into a silver halide emulsion according to the procedure mentioned hereinafter. The present compounds, if necessary, together with couplers, hydroquinone derivatives and/or known fading inhibitors, are simultaneously dissolved in high boiling point solvents such as organic acid amides, carbamates, esters, ketones, urea derivatives, particularly di-n-butyl phthalate, tricresyl phosphate, diisooctyl azelate, di-n-butyl sebacate, tri-n-hexyl phosphate, N,N-diethyl-caprylamidobutyl, n-pentadecylphenyl ether, triphenyl phosphate, dioctyl phthalate, n-nonylphenol, N,N-diethyl laurylamide, 3-pentadecylphenyl ethyl ether, monophenyl-di-o-chlorophenyl phosphate or fluorinated paraffins and/or, if necessary, are dissolved in low boiling point solvents such as methyl acetate, ethyl acetate, propyl acetate, butyl acetate, butyl propionate, cyclohexanol, cyclohexantetrahydrofuran, methyl alcohol, ethyl alcohol, acetonitrile, dimethylformaide, dioxane, methyl ethyl ketone, methyl isobutyl ketone, diethylene glycol monoacetate, acetyl acetone, nitromethane, nitoethane, carbon tetrachloride or chloroform (said high boiling point solvents and low boiling point solvents may be used either singly or in combination thereof). The resulting solution is mixed with an aqueous solution comprising such hydrophilic binder as gelatin or the like and further containing anionic type surface active agents such as an alkylbenzenesulfonic acid and an alkylnaphthalenesulfonic acid and/or such nonionic type surface active agents as sorbitane seaquioleate and sorbitane monolaurate, and the resulting mixture is well mixed by a high speed rotary mixer, a colloid mill or a supersonic dispersing apparatus to prepare an emulsified dispersion which is then incorporated into a silver halide emulsion.

Of the present compounds, those which are in a liquid state at an ordinary temperature or which are relatively low in melting point may also be used as high boiling point solvents without using the aforesaid high boiling point solvents, and such oleophilic compounds as couplers, etc. may be dissolved therein.

If, in such case, the coupler used are diffusible, said couplers are added to a color developing solution, and the present compounds, if necessary together with additives other than said couplers are added into an emulsified dispersion which is then incorporated into a silver halide emulsion.

Further, the present compounds have sufficient effects thereof even when incorporated into a color photographic material obtained by subjecting a silver halide color photographic material to development treatment.

The amount of the present compounds to be added is not particularly limited since there is no detrimental influence, such as coloration or stain, due to the present compounds, per se, because said compounds are substantially colorless. The amount of the compound of the aforesaid general formula [I] is sufficiently about 15 g per mole of a dye formed by a color development treatment. Mainly for economical reasons, however in a coupler-containing silver halide color photographic material, the amount of said compound is generally preferably 5 to 300% by weight, particularly preferably 10 to 100% by weight, based on couplers used, and in the case of a coupler-free silver halide color photographic material, said amount is 10 to 100 g, particularly preferably 15 to 60 g, based on 1 mole of silver halide. The amount of the compound of the aforesaid general formula [II], on the other hand, is preferably 1 to 300% by weight, particularly preferably 2 to 100% by weight, based on the compound of the aforesaid general formula [I] used in the case of either a coupler containing silver halide color photographic material or a coupler-free silver halide color photographic material.

The hydroquinone derivatives may be used in combination with the present compounds effectively and the derivatives include precursors thereof. The precursors as used herein means compounds which release hydroquinone derivatives on hydrolysis. Such precursors include, for example, compounds having one or two hydroxyl groups of the hydroquinone nucleus which have been acylated (e.g.

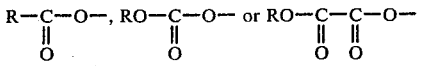

in which R represents such an aliphatic group as an alkyl group or the like group).

The hydroquinone derivatives used in the present invention include, as their representatives, compounds represented by the following general formula [III]:

General formula (III)

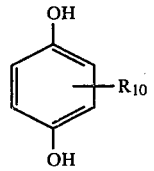

wherein $R_{10}$ represents an alkyl group (e.g. methyl, t-butyl, t-amyl, octyl, t-octyl, dodecyl, octadecyl, etc.), an aryl group (e.g. phenyl), an alkoxy group (e.g. methoxy, butoxy, dodecyloxy, etc.), an aryloxy group (e.g. phenoxy), a carbamoyl group (e.g. methylcarbamoyl, dibutylcarbamoyl, octadecylcarbamoyl, phenylcarbamoyl, etc.), a sulfamoyl group (e.g. methylsulfamoyl, octadecylsulfamoyl, etc.), an acyl group (e.g. acetyl, octanoyl, lauroyl, etc.), an alkoxycarbonyl group (e.g. methoxycarbonyl, dodecylcarbonyl, etc.) or an aryloxycarbonyl group (e.g. phenyloxycarbonyl, etc.), and the alkyl and aryl groups include the substituted having such substituent as halogen, alkyl, aryl, alkoxy, aryloxy, carboxy, alkoxycarbonyl, aryloxycarbonyl, acyl, sulfo, sulfamoyl, sulfonamido, M-alkylamino, N-arylamino, acylamino, imido or hydroxy, and 1 to 3 of the remaining three hydrogen atoms on an aromatic nucleus of the hydroquinone may be substituted with halogen and/or 1 to 3 groups (the groups may be the same or different) of the groups defined as $R_{10}$ mentioned above.

The substituted hydroquinone derivatives usable in the present invention are concretely illustrated, for example, U.S. Pat. Nos. 2,336,327, 2,360,290, 2,384,658, 2,403,721, 2,418,613, 2,675,314, 2,701,197, 2,704,713, 2,710,801, 2,711,556, 2,727,659, 2,732,300, 2,735,765, 2,816,028, 3,062,884 and 3,236,893, British Pat. Nos. 557,750 and 557,802, West German Patent Publication No. 2,149,789, Japanese Patent Publication No. 54116/1969, Japanese Laid-Open-to-Public Patent Publication No. 2128/1971 and Journal of Organic Chemistry, Vol. 22, pp. 772–774.

Of the substituted hydroquinone derivatives, those having on the nucleus the substituents, of which the total carbon atoms is at least 8, are low in diffusibility and suitable for making such derivatives selectively present in a specific hydrophilic layer of a light-sensitive material.

Of the hydroquinone derivatives used in the present invention, those having on the nucleus substituted or unsubstituted alkyl as a substituent are particularly useful.

Examples of the hydroquinone derivative used in the present invention are illustrated below, but usable derivatives are not limited only thereto.

Hq-1

2,5-di-tert-Octylhydroquinone

Hq-2

2-t-Octyl-5-methylhydroquinone
Hq-3
2,6-di-n-Dodecyl-hydroquinone
Hq-4
2-n-Dodecylhydroquinone
Hq-5
2,2'-Methylenebis-5,5'-di-t-butylhydroquinone
Hq-6
2,5-di-n-Octyl-hydroquinone
Hq-7
2-Dodecylcarbamoylmethylhydroquinone
Hq-8
2(β-n-dodecyloxycarbonyl)ethyl-hydroquinone
Hq-9
2-(N,N-dibutylcarbamoyl)hydroquinone
Hq-10
2-n-Dodecyl-5-chloro-hydroquinone
Hq-11
2-(2-Octadecyl)-5-methylhydroquinone
Hq-12
2,5-di-(p-Methoxyphenyl)hydroquinone
Hq-13
2-t-Octadecylhydroquinone
Hq-14
2-[β-{3-(3-Sulfobenzamido)benzamido}ethyl]-hydroquinone
Hq-15
2,5-dichloro-3,6-diphenylhydroquinone
Hq-16
2,6-Dimethyl-4-t-octylhydroquinone
Hq-17
2,3-Dimethyl-5-t-octylhydroquinone
Hq-18
2-{β-(dodecanoyloxy)ethyl}carbamoylhydroquinone
Hq-19
2-Dodecyloxycarbonylhydroquinone
Hq-20
2-{β-(4-Octanamidophenyl)ethyl}hydroquinone
Hq-21
2-Methyl-5-dodecylhydroquinone These hydroquinone derivatives are used singly or in combination of two or more, and the amount thereof to be added to a coupler-containing silver halide color photographic material is usually 0.01 to 10 moles, preferably 0.1 to 3 moles, per mole of the coupler. In the case of a coupler free silver halide color photographic material, said amount is preferably 0.01 to 1.0 mole, particularly preferably 0.02 to 0.6 mole, per mole of silver halide.

Usable as dye-image-forming couplers in the silver halide color photographic material according to the present invention include as representatives the compounds disclosed in the under-mentioned patents.

Of the couplers referred to the above, yellow dye image forming couplers are those of benzoylacetanilide type, pivaroylacetanilide type and dibenzylmethane type, or 2-equivalent type yellow dye image forming couplers in which the carbon atom at the coupling position has been substituted with a substituent (so-called split off group) which is capable of releasing at the time of coupling reaction. These couplers are disclosed, for example, in U.S. Pat. Nos. 2,778,658, 2,875,057, 2,908,573, 3,227,155, 3,227,550, 3,253,924, 3,265,506, 3,277,155, 3,341,331, 3,369,895, 3,384,657, 3,408,194, 3,415,652, 3,447,928, 3,551,155, 3,582,322 and 3,725,072, German Patent Publication Nos. 1,547,868, 2,057,941, 2,162,899, 2,163,812, 2,213,461, 2,219,917, 2,261,361 and 2,263,875, Japanese Patent Publication No. 13576/1974, Japanese Laid-Open-to-Public Patent Publication Nos. 29432/1973, 66834/1973, 10736/1974, 122335/1974, 28834/1975 and 132926/1975. Magenta dye image forming couplers are those of 5-pyrazolone type, pyrazolotriazole type, pyrazolinobenzimidazole type, indazolone type and cyanacetyl type or 2-equivalent type magenta dye image forming couplers. These couplers are disclosed, for example, in U.S. Pat. Nos. 2,600,788, 3,062,653, 3,127,269, 3,311,476, 3,152,896, 3,419,391, 3,519,429, 3,558,318, 3,684,514, 3,888,680, 3,907,751, 3,928,044, 3,930,861, 3,930,866 and 3,933,500, Japanese Laid-Open-to-Public Publication Nos. 29639/1974, 111631/1974, 129538/1974 and 13041/1975, Japanese Patent Application Nos. 24690/1975, 134470/1975 and 156327/1975, British Patent 1,274,493, Belgian Patent 792,525, U.S. Pat. No. 3,061,432, West German Pat. No. 2,156,111, Japanese Patent Publication No. 60479/1971 and Belgian Pat. No. 769,116.

Cyan dye image forming couplers are those of phenol type and naphthol type, or 2-equivalent type cyan dye image forming couplers having split off groups. These couplers are disclosed, for example, in U.S. Pat. Nos. 2,369,929, 2,423,730, 2,434,272, 2,474,293, 2,698,794, 2,706,684, 2,772,162, 2,801,171, 2,895,826, 2,908,573, 3,034,892, 3,046,129, 3,227,550, 3,253,294, 3,311,476, 3,386,301, 3,419,390, 3,458,315, 3,476,563, 3,516,831, 3,560,212, 3,582,322, 3,583,971, 3,591,383, 3,619,196, 3,632,347, 3,652,286, 3,737,326, 3,758,308, 3,779,763 and 3,839,044, German Patent Publication Nos. 2,163,811 and 2,207,468, Japanese Patent Publication Nos. 27563/1964 and 28836/1970, Japanese Laid-Open-to-Public Patent Publication Nos. 37425/1972, 10135/1975, 25228/1975, 112038/1975, 117422/1975 and 130441/1975.

Typical examples of the dye image forming couplers used in the present invention are illustrated below.

(Y-1)
α-(4-Carboxyphenoxy)-α-pivaryl-2-chloro-5-[γ-(2,4-di-t-amylphenoxy)butylamido]acetanilide
(Y-2)
α-Benzoyl-2-chloro-5-[γ-2,4-di-t-amylphenoxybutylamido]acetanilide
(Y-3)
α-Benzoyl-2-chloro-5-[α-(dodecyloxycarbonyl)ethoxycarbonyl]acetanilide
(Y-4)
α-(4-Carboxyphenoxy)-α-pivaryl-2-chloro-5-[α-(3-pentadecylphenoxy)butylamido]acetanilide
(Y-5)
α-(1-Benzyl-2,4-dioxo-3-imidazolidinyl)-α-pivaryl-2-chloro-5-[γ-(2,4-di-t-amylphenoxy)butylamido]acetanilide
(Y-6)
α-[4-(1-Benzyl-2-phenyl-3,5-dioxo-1,2,4-triazolidinyl)]-α-pivaryl-2-chloro-5-[γ-(2,4-di-t-amylphenoxy)butylamido]acetanilide
(Y-7)
α-Acetoxy-α-3-[α-(2,4-di-t-amylphenoxy)-butylamido]benzoyl-2-methoxyacetanilide
(Y-8)
α-{3-[α-(2,4-di-t-Amylphenoxy)butylamido]benzoyl}-2-methoxyacetanilide
(Y-9)
α-[4-(4-Benzyloxyphenylsulfonyl)phenoxy]-α-pivaryl-2-chloro-5-[γ-(2,4-di-t-amylphenoxy)-butylamido]acetanilide (Y-10)
α-Pivaryl-α-(4,5-dichloro-3-(2H)-pyridazo-2-il)-2-chloro-5-[(hexadecyloxycarbonyl)methoxycarbonyl-]acetanilide
(Y-11)
α-Pivaryl-α-[4-(p-chlorophenyl)-5-oxo-$\Delta^2$-tetrazolin-1-il]-2-chloro-5-[α-dodecyloxycarbonyl)ethoxycarbonyl]acetanilide
(Y-12)
α-(2,4-Dioxo-5,5-dimethyloxazolidine-3-il)-α-pivaryl-2-chloro-5-[α-(2,4-di-t-amylphenoxy)-butylamido]acetanilide
(Y-13)
α-Pivaryl-α-[4-(1-methyl-2-phenyl-3,5-dioxo-1,2,4-triazolidinyl)]-2-chloro-5-[γ-(2,4-di-t-amylphenoxy)-butylamido]acetanilide
(Y-14)
α-Pivaryl-α-[4-(p-ethylphenyl)-5-oxo-$\Delta^2$-tetrazolin-1-il]-2-chloro-5-[γ-(2,4-di-t-amylphenoxy)-butylamido]acetanilide
(M-1)
1-(2,4,6-Trichlorophenyl)-3-[3-(2,4-di-t-amylphenoxyacetamido)benzamido]-5-pyrazolone
(M-2)
1-(2,4,6-Trichlorophenyl)-3-(3-dodecylsuccinimidobenzamido)-5-pyrazolone
(M-3)
4,4'-Methylenebis{1-(2,4,6-trichlorophenyl)-3-[3-(2,4-di-t-amylphenoxyacetamido)benzamido]-5-pyrazolone}
(M-4)
1-(2,4,6-Trichlorophenyl)-3-(2-chloro-5-octadecylsuccinimidoanilino)-5-pyrazolone
(M-5)
1-(2-Chloro-4,6-dimethylphenyl)-3-{3-[α-(3-pentadecylphenoxy)butylamido]benzamido}-5-pyrazolone
(M-6)
1-(2,4,6-Trichlorophenyl)-3-(2-chloro-5-octadecylcarbamoylanilino)-5-pyrazolone
(M-7)
3-Ethoxy-1-{4-[α-(3-pentadecylphenoxy)-butylamido]phenyl}-5-pyrazolone
(M-8)
1-(2,4,6-Trichlorophenyl)-3-(2-chloro-5-tetradecanamidoanilino)-5-pyrazolone
(M-9)
1-(2,4,6-Trichlorophenyl)-3-{2-chloro-5-[α-(3-butyl-4-hydroxyphenoxy)tetradecanamido]anilino}-5-pyrazolone
(M-10)
1-(2,4,6-Trichlorophenyl)-3-[3-(2,4-di-t-amylphenoxyacetamido)benzamido]-4-acetoxy-5-pyrazolone
(M-11)
1-(2,4,6-Trichlorophenyl)-3-[3-(2,4-di-t-amylphenoxyacetamido)benzamido]-4-ethoxycarbonyloxy-5-pyrazolone
(M-12)
1-(2,4,6-Trichlorophenyl)-3-[3-(2,4-di-t-amylphenoxyacetamido)benzamido]-4-(4-chlorocinnamoyloxy)-5-pyrazolone)
(M-13)
4,4'-Benzylidenebis[1-2,4,6-trichlorophenyl)-3-{2-chloro-5-[γ-(2,4-di-t-amylphenoxy)anilino}-5-pyrazolone
(M-14)
4,4'-Benzylidenebis[1-(2,3,4,5,6-pentachlorophenyl)-3-{2-chloro-5-[γ-(2,4-di-t-amylphenoxy)-butylamido]anilino}-5-pyrazolone]
(M-15)
4,4'-(2-Chloro)benzylidenebis[1-(2,4,6-trichlorophenyl)-3-(2-chloro-5-dodecylsuccinimidoanilino-5-pyrazolone]
(M-16)
4,4'-Methylenebis[1-(2,4,6-trichlorophenyl)-3-{3-[α-(2,4-di-t-amylphenoxy)butylamido]benzamido}-5-pyrazolone]
(M-17)
1-(2,6-Dichloro-4-methoxyphenyl)-3-(2-methyl-5-acetamidoanilino)-5-pyrazolone
(M-18)
1-(2-Chloro-4,6-dimethylphenyl)-3-(2-methyl-5-chloroanilino)-5-pyrazolone
(M-19)
1-(2,4,6-Trichlorophenyl)-3-(4-nitroanilino)-5-pyrazolone
(C-1)
1-Hydroxy-N-[δ-(2,4-di-t-amylphenoxy)butyl]-2-naphthamide
(C-2)
2,4-Dichloro-3-methyl-6-(2,4-di-t-amylphenoxyacetamido)phenol
(C-3)
2,4-Dichloro-3-methyl-6-[α-(2,4-di-t-amylphenoxy)-butylamido]phenol
(C-4)
1-Hydroxy-4-(3-nitrophenylsulfonamido)-N-[δ-(2,4-di-t-amylphenoxy(butyl]-2-naphthamide
(C-5)
1-Hydroxy-4-[(β-methoxyethyl)carbamoyl]methoxy-N-[δ-(2,4-di-t-amylphenoxy)butyl]-2-naphthamide
(C-6)
1-Hydroxy-4-(isopropylcarbamoyl)methoxy-N-dodecyl-2-naphthamide
(C-7)
2-Perfluorobutylamido-5-[α-(2,4-di-t-amylphenoxy)-hexanamido]phenol
(C-8)
1-Hydroxy-4-(4-nitrophenylcarbamoyl)oxy-N-[δ-(2,4-di-t-amylphenoxy)butyl]-2-naphthamide
(C-9)
2-(α,α,β,β-tetrafluoropropionamido)-5-[α-(2,4-di-t-amylphenoxy)butylamido]phenol
(C-10)
1-Hydroxy-N-dodecyl-2-naphthamide
(C-11)
1-Hydroxy-(4-nitro)phenoxy-N-[δ-(2,4-di-t-amylphenoxy)butyl]-2-naphthamide
(C-12)
1-Hydroxy-4-(1-phenyl-5-tetrazolyloxy)-N-[δ-(2,4-di-amylphenoxy)butyl]-2-naphthamide
(C-13)
2-(α,α,β,β-tetrafluoropropionamido)-4-p-chloroethoxy-5-[α-(2,4-di-t-amylphenoxy)butylamido]phenol
(C-14)
2-Chloro-3-methyl-4-ethylcarbamoylmethoxy-6-[α-(2,4-di-t-amylphenoxy)butylamido]phenol The coupler used in the silver halide color photographic material according to the present invention, when incorporated into a silver halide color photographic material, is generally in an amount of 5 to 50 mole%, preferably 10 to 30 mole%, based on silver halide, and when incorporated into a developer solution, generally in an amount of 0.5 to 3.0 g/l, preferably 1.0 to 2.0 g/l. In this case, the yellow, magenta and cyan couplers may be used either singly or in combination of two or more, and the amount of couplers used in combination of two or more is sufficiently the same as mentioned above.

The silver halide emulsion used in the silver halide color photographic material according to the present invention is generally an emulsion prepared by dispersing silver halide particles in a hydrophilic colloid. The silver halide includes silver chloride, silver bromide, silver iodide, silver chlorobromide, silver iodobromide, silver chloroiodobromide and the mixtures thereof, and these silver halides are prepared according to various procedures such as an ammonia process, a neutralization process, the so-called conversion process and a simultaneous mixing process. The hydrophilic colloid in which the silver halide is dispersed is generally gelatin, and such gelatin derivative as phthalated gelatin or malonated gelatin. The gelatin or gelatin derivatives used may be replaced partly or wholly by albumin, agar, gum arabic, alginic acid, casein, partially hydrolyzed cellulose derivative, partially hydrolyzed polyvinyl acetate, polyacrylamide, imidized polyacrylamide, polyvinylpyrrolidone and copolymers of these vinyl compounds. Further the silver halide emulsion may be optically sensitized using various sensitizing dyes in order to impart sensitivity at a desired lightsensitive wavelength region. Preferable sensitizing dyes include cyanine dyes, merocyanine dyes or composite cyanine dyes which are used either singly or in combination as disclosed, for example, in U.S. Pat. Nos. 1,939,201, 2,072,908, 2,688,545, 2,739,149, 2,912,329, 2,294,763, 2,213,995, 2,493,748, 2,519,001, 3,397,060 and 3,628,964, West German Pat. No. 929,080, British Pat. Nos. 1,195,302, 1,242,588, 1,293,852 and 505,979, West German Patent Publication Nos. 2,030,326 and 2,212,780, Japanese Patent Publication Nos. 4936/1968 and 14030/1969. If necessary, the silver halide emulsion may be incorporated with chemical sensitizers such as gold compounds; noble metal salts of platinum, paladium, iridium rhodium, rethenium and the like; sulfur compounds; reducing substances or thiether compounds; quaternary ammonium compounds or polyalkylene oxide compounds; stabilizing agents such as triazoles, imidazoles, azaindenes, benzothiazoliums, zinc compounds, cadmium compounds and mercaptans; chromic salts, zirconium salts, mucochloric acid, as disclosed in U.S. Pat. Nos. 1,574,944, 2,399,083, 2,410,689, 2,448,060, 2,487,850, 2,518,698, 2,521,925, 2,521,926, 2,540,085, 2,540,086, 2,566,245, 2,566,263, 2,597,856, 2,597,915, 2,598,079, 2,983,610, 3,189,458, 3,201,254 and 3,501,313; and various photographic additives including film hardeners of aldehyde type, triazine type, polyepoxy compounds, active halogen compounds, ketone compounds, acryloyl type, triethylenephosphamide type and ethyleneimine type; plasticizers such dihydroxy alkanes as glycerine and 1,5-pentanediol; fluorscent brightening agents; antistatic agents; coating aids and the like as disclosed in Japanese Patent Publication Nos. 7133/1959 and 1872/1971, British Pat. Nos. 686,440, 974,723, 994,869, and 1,332,647, U.S. Pat. Nos. 682,641, 2,725,295, 2,732,303, 2,732,316, 2,983,611, 3,017,280, 3,091,537, 3,100,704, 3,103,437, 3,321,313, 3,325,287, 3,302,827, 3,543,292, 3,635,718 and 3,736,320, and these additives may be used either singly or in combination of two or more. The silver halide emulsion thus obtained is incorporated with a dispersion of the present compounds of the general formulas [I] and [II] and others ingredients as aforesaid and then coated on a support such as synthetic resin film cellulose acetate, cellulose nitrate, polycarbonate, polyethylene terephthalate or polystyrene, baryta paper, polyethylene-coated paper, glass plate or the like, if necessary through a sub layer, an antihalation layer, an intermediate layers, a yellow filter layers, a protective layer and or the like, thereby to obtain a silver halide color photographic material.

The silver halide color photographic material according to the present invention may be applicable to coupler-containing inner type silver halide color photographic materials or external type silver halide color photographic materials where couplers are contained in a developer, but particularly advantageously applicable to the coupler-containing inner type silver halide color photographic materials which are advantageously developed, after exposure, according to color development method. The present invention may also be applicable to such silver halide color photographic materials that couplers and a color developing agent are made present in the same layer so as not to contact with each other by means of protection and so as to contact with each other after exposure, or also applicable to coupler-containing such silver halide color photographic materials that a color developing agent is contained in a layer which does not contain the couplers, the color developing agent is moved when an alkaline processing solution is permeated into the photographic material so as to contact with said couplers. Further, in the case of silver halide color photographic materials for diffusion transfer, the present compounds may be incorporated into a light-sensitive element and/or an image-receiving element of said photographic material, particularly advantageous is the incorporation of the present compounds into the image-receiving element. In the case of reversal method, the exposed photographic material is developed with a black-and-white developer, followed by exposure to white light or a treatment with a bath containing such fogging agent as a boron compound, and then subjected to color development with an alkaline developer containing a color developing agent. In this case, the fogging agent may be contained in the alkaline developer containing the color developing agent. The color developed photographic material is subjected to a bleaching treatment with a bleaching solution containing ferricyanide of ferric salts of aminopolycarboxylic acids and then subjected to a fixing treatment with a fixing solution containing a silver salt solvent such as thiosulfate, thereby to remove a silver image and remaining silver halide, and then a dye image is left. Bleach-fixing may be carried out by the use of a one bath bleach fixing solution containing an oxidizing agent such as ferric salts of aminopolycarboxylic acids and a silver salt solvent such as thiosulfate in place of the bleaching and fixing solutions. Further, such treatments as pre-hardening, neutralization, water-washing, stopping and stabilization can be carried out in combination with the color development, bleaching and fixing or bleach-fixing. Treatment steps by which the silver halide color photographic materials of the present invention can be advantageously color-developed include, for example, color development, if necessary, water-washing, bleach-fixing, water-washing and, if necessary, stabilizing and drying. The above-mentioned treatment steps may be conducted, for example, at elevated temperatures above 30° C. and within a very short time.

Aromatic primary amine compounds as particularly useful color developing agents for the color development of the silver halide color photographic materials of the present invention are primary phenylenediamines, aminophenols and derivatives thereof and the following may be mentioned, for example, as the typical examples thereof.

The typical examples of the color developing agent include N,N-dimethyl-p-phenylenediamine, N,N-diethyl-p-phenylenediamine, N-carbamidomethyl-N-methyl-p-phenylenediamine, N-carbamidomethyl-N-tetrahydrofurfuryl-2-methyl-p-phenylenediamine, N-ethyl-N-carboxymethyl-2-methyl-p-phenylenediamine, N-carbamidomethyl-N-ethyl-2-methyl-p-phenylenediamine, N-ethyl-N-tetrahydrofurfuryl-2-methyl-p-aminophenol, 3-acetylamino-4-aminophenol, 3-acetylamino-4-aminodimethylaniline, N-ethyl-N-$\beta$-methanesulfonamidoethyl-4-aminoaniline, N-ethyl-N-$\beta$-methanesulfonamidoethyl-3-methyl-4-aminoaniline, N-methyl-N-$\beta$-sulfoethyl-p-phenylenediamine, and salts of such inorganic acids, as hydrochloric acids or such organic acids as p-toluenesulfonic acid of o-aminophenol, p-aminophenol and 5-amino-2-oxy-toluene.

The color developer may be incorporated, if necessary, with various additives in addition to the above-mentioned color developing agents. Principal examples of such additives include, for example, alkali agents such as hydroxides of alkali metals or ammonium, carbonates and phosphates, buffers such as an acetic acid and a boric acid, a pH regulating agent, development accelerators, antifoggants, anti-stain or anti-sludge agents, multi-layer effect accelerators and constant state maintaining agents.

Bleaching agents used in the bleach treatment include ferricyanide, bichromates, permanganates, hydrogen peroxide, bleaching powder, metal complex salts of aminopolycarboxylic acids such as an ethylenediamine tetraacetic acid, a nitrotriacetic acid and an iminodiacetic acid, and metal complex salts and ferric chlorides of polycarboxylic acids such as a malonic acid, a tariaric acid, a maleic acid and a digoricolic acid, and they are used singly, or, if necessary, in combination thereof. The bleaching solution may also be incorporated, if necessary, with various additives such as bleaching accelerators.

Fixing agents used in the fixing treatment include thiosulfates such as sodium thiosulfate and ammonium thiosulfate, cyanide and urea derivatives, and the fixing solution may be incorporated, if necessary, with various additives such as fixing accelerators.

Silver halide color photographic materials containing the present compounds may also be advantageously processed with a developer solution containing both the primary aromatic amine type color developing agent and an oxidizing agent capable of subjecting a metallic silver image to redox reaction.

When the above-mentioned color developer solution is used, the color developing agent is oxidized by the oxidizing agent and then the resulting oxidation product couples with the photographic coupler to form a dye image. Such color developer solutions are disclosed, for example, in Japanese Laid-Open-to-Public Patent Publication No. 9729/1973 and a preferable oxidizing agent for this purpose is a cobalt salt having a coordination number of 6. The color photographic treatment involving the use of such color developer solution is particularly effective for the so-called silver-saving color photographic materials, of which the amount of silver used is smaller than that in ordinary silver halide color photographic materials.

Particularly useful cobalt complex salts are those which contain a ligand selected from the group consisting of ethylenediamine, diethylenetriamine, triethylenetetramine, amine, nitrate, nitrite, azide, chloride, thiocyanate, isothiocyanate, water and carbonate and also have (1) at least 2 ethylenediamine ligands or (2) at least 5 ethylene ligands or (3) at least 1 triethylenetetramine ligand. Particularly preferable cobalt complexes are, for example, complex salts represented by the following formulas: $[Co(En)_2(N_3)_2]X$; $[Co(En)_2Cl(NCS)]X$; $[Co(En)_2(NH_3)N_3]X$: $[Co(En)_2Cl_2]X$; $[Co(En)_2(SCN)_2]X$; $[Co(En)_2(NCS)_2]X$; and $[CO(NH_3)_6]X$.

In the above formulas, En represents ethylenediamine and X represents at least one anion selected from chloride, bromide, nitrite, nitrate, perchlorate, acetate, carbonate, sulfite, sulfate, hydrochloride, thiocyanate, isothiocyanate and hydroxide. Most preferable complex salt are hexamine salts of cobalt, for example, chlorides, bromides, sulfites, sulfates, perchlorates, nitrites and acetates. The cobalt complex salt used in the color developer solution is generally employed in the concentration range of about 0.1 to about 50 g, more preferably in the concentration range of about 1 to about 15 g, per liter of the color developer solution.

The silver halide color photographic materials using the present compounds are also advantageously subjected to a color photographic treatment comprising effecting the development of the photographic material in a color developer solution containing a primary aromatic amine type color developing agent preferably in the presence of such color developing agent as capable of being received during color development step in light-sensitive layers and being moved in an amplifying bath, and then contacting the thus processed photographic material with the amplifying bath containing the aforesaid oxidizing agent, for example, a cobalt complex salt having coordination number of 6. Other oxidizing agent preferable for use in attaining this purpose includes also an aqueous hydrogen peroxide solution disclosed, for example, in Japanese Patent Application No. 80321/1974. The amplifying bath is preferably incorporated with a silver halide development inhibitor in addition to the oxidizing, so that a silver halide color photographic material may be subjected to an amplification treatment under room illumination. According to this technique, formation of a dye can be observed and the amplification treatment can be stopped as soon as a desired dye density is attained. Preferable development inhibitors are water-soluble bromide compounds such as potassium bromide, tetrazole containing no mercapto group or ionic iodide, azaindene and heterocyclic compounds such as triazole.

The concentration of a cobalt salt to be incorporated into the amplifying bath is generally about 0.2 to about 20 g/l, most preferably about 1 to about 15 g/l, and the concentration of the aqueous hydrogen peroxide is generally about 0.01 to 10%, most preferably about 0.5 to 5%. The water-soluble bromide incorporated as the development inhibitor into the amplifying bath is generally in an amount of about 1 to about 40 g/l and, on the other hand the development inhibitor comprising a compound having a heterocyclic structure in used generally in a concentration of about 0.001 to about 5 g/l. The amplifying bath is used generally at pH 6–14, preferably pH 8–12.

The amplifying bath may be incorporated, in addition to the above-mentioned development inhibitor, with development accelerators, stabilizing agents, watersoftening agents, thickeners and uneven treatment inhibitors.

The present compounds also show sufficient effects on the prevention of fading of diazo light-sensitive materials.

The present invention is concretely illustrated below with reference to examples, but embodiments of the invention are not limited thereby.

EXAMPLE 1

Magenta couplers, the present compounds and hydroquinone derivatives shown in Table 1-1 were individually dissolved in solvents indicated in said table to prepare solutions. The solutions were individually incorporated with 500 cc of a 5% aqueous gelatin solution containing 2.5 g of sodium dodecylbenzenesulfate and dispersed by means of a homogenizer. The dispersions thus obtained were individually incorporated into 1,000 cc of a green sensitive silver chlorobromide emulsion (containing 20 mole% of silver chloride). The emulsions individually incorporated with 10 ml of a 2% methanol solution of N,N',N''-triacryloyl-6H-S-triazine as a film hardener were individually coated on a polyethylene-coated paper and then dried to obtain light-sensitive silver halide photographic materials (samples Nos. 1–12). After wedgewise exposure, these samples were processed according to the under-mentioned treatment steps and then irradiated for 50, 100 and 200 hours, respectively, by means of a Xenon fade-o-meter. The irradiated samples were measured with Sakura Color densitometer PD-6 Model (manufactured by Konishiroku Photo Industry Co., Ltd.) as to the residual dye ratio in percentages (D/Do×100) of density (D) after irradiation relative to density (Do=1.0) before irradiation, with green light and in Y-stain increasing ratio with blue light. The results obtained were as shown in Table 1-2.

| Treatment steps (30° C.) | Treatment time |
|---|---|
| Corlor development | 3 min. and 30 sec. |
| Bleach-fixing | 1 min. and 30 sec. |
| Water-washing | 2 min. |
| Stabilization | 1 min. |
| Drying | |
| Composition of color developing solution: | |
| Benzyl alcohol | 5.0 ml |
| Sodium hexametaphosphate | 2.5 g |

-continued

| | |
|---|---|
| Anhydrous sodium sulfite | 1.9 g |
| Sodium bromide | 1.4 g |
| Potassium bromide | 0.5 g |
| Boric acid ($Na_2B_4O_7 \cdot 10\ H_2O$) | 39.1 g |
| N-Ethyl-N-β-methanesulfonamidoethyl-4-aminoaniline sulfate | 5.0 g |
| Water to make 1 liter | |
| Adjusted to pH 10.30 with sodium hydroxide. | |
| Composition of bleach-fixing solution: | |
| Ammonium ferric ethylenediaminetetraacetate | 61.0 g |
| Diammonium ethylenediaminetetraacetate | 5.0 g |
| Ammonium thiosulfate | 124.5 g |
| Sodium metabisulfate | 13.3 g |
| Anhydrous sodium sulfite | 2.7 g |
| Water to make 1 liter | |
| Adjusted to pH 6.5 with ammonia water. | |
| Composition of stabilizing solution: | |
| Glacial acetic acid | 20 ml |
| Water to make 800 ml | |
| Adjusted to pH 3.5–4.0 by use of sodium acetate | |
| Additional water to make 1 liter | |

Table 1 - 1

| Sample No. | Exemplified coupler and amount added (g) | | Exemplified compound and amount added (g) | | Hydroquinone compound and amount added (g) | | High boiling point solvent and amount used (cc) | | Low boiling point solvent and amount used (cc) | |
|---|---|---|---|---|---|---|---|---|---|---|
| 1 | M-1 | 36 | (1) | 11 | Hq-1 | 1.1 | DBP | 36 | EA | 100 |
| | | | (29) | 5.5 | | | | | | |
| 2 | M-1 | 36 | (3) | 11 | " | 1.1 | DBP | 36 | EA | " |
| | | | (29) | 11 | | | | | | |
| 3 | M-1 | 36 | (13) | 11 | " | 1.1 | DBP | 36 | EA | " |
| | | | (29) | 6.5 | | | | | | |
| 4 | M-3 | 39 | (4) | 12 | " | 1.2 | TCP | 39 | MA | " |
| | | | (34) | 3.6 | | | | | | |
| 5 | M-3 | 39 | (15) | 12 | " | 1.2 | TCP | 39 | MA | " |
| | | | (34) | 12 | | | | | | |
| 6 | M-3 | 39 | (20) | 12 | " | 1.2 | TCP | 39 | MA | " |
| | | | (34) | 24 | | | | | | |
| 7 | M-4 | 39 | (5) | 12 | " | 0.97 | DBP | 18 | MA | " |
| | | | (40) | 12 | | | | | | |
| 8 | M-4 | 39 | (14) | 12 | " | 0.97 | TCP | 18 | MA | " |
| | | | (40) | 6 | | | | | | |
| 9 | M-4 | 39 | (25) | 12 | " | 0.97 | TCP | 18 | MA | " |
| | | | (40) | 1.2 | | | | | | |

In the above table, DBP represents dibutyl phthalate, TCP represents tricresyl phosphate, EA represents ethyl acetate and MA represents methyl acetate, and the same will apply hereinafter.

Table 1 - 2

| Irradiation time | Residual dye ratio | | | Y-stain increasing ratio | | |
|---|---|---|---|---|---|---|
| Sample No. | 50 | 100 | 200 | 50 | 100 | 200 |
| 1 | 91 | 85 | 68 | 196 | 560 | 1,330 |
| Comparison-1 | 91 | 84 | 65 | 280 | 810 | 1,900 |
| Comparison-2 | 85 | 76 | 53 | 200 | 600 | 1,340 |
| Comparison-3 | 73 | 51 | 32 | 430 | 926 | 2,500 |
| 2 | 994 | 86 | 69 | 200 | 530 | 1,270 |
| Comparison-1 | 94 | 85 | 67 | 300 | 815 | 1,950 |
| Comparison-2 | 87 | 65 | 47 | 210 | 540 | 1,280 |
| Comparison-3 | 73 | 51 | 32 | 430 | 926 | 2,500 |
| 3 | 94 | 88 | 70 | 225 | 603 | 1,450 |
| Comparison-1 | 94 | 88 | 70 | 300 | 805 | 1,930 |
| Comparison-2 | 83 | 69 | 51 | 240 | 603 | 1,460 |
| Comparison-3 | 73 | 51 | 32 | 430 | 926 | 2,500 |
| 4 | 92 | 87 | 74 | 200 | 430 | 1,180 |
| Comparison-1 | 92 | 85 | 72 | 340 | 720 | 1,960 |
| Comparison-2 | 89 | 79 | 58 | 220 | 450 | 1,200 |
| Comparison-3 | 71 | 53 | 35 | 450 | 730 | 2,600 |

Table 1 - 2-continued

| Irradiation time | Residual dye ratio | | | Y-stain increasing ratio | | |
|---|---|---|---|---|---|---|
| Sample No. | 50 | 100 | 200 | 50 | 100 | 200 |
| 5 | 98 | 94 | 79 | 190 | 400 | 990 |
| Comparison-1 | 97 | 92 | 76 | 320 | 660 | 1,650 |
| Comparison-2 | 90 | 85 | 69 | 200 | 400 | 980 |
| Comparison-3 | 70 | 54 | 69 | 450 | 930 | 2,600 |
| 6 | 96 | 83 | 76 | 200 | 429 | 1,130 |
| Comparison-1 | 95 | 80 | 73 | 335 | 715 | 1,890 |
| Comparison-2 | 87 | 72 | 69 | 200 | 410 | 1,100 |
| Comparison-3 | 70 | 54 | 36 | 450 | 930 | 2,600 |
| 7 | 98 | 88 | 88 | 252 | 620 | 1,800 |
| Comparison-1 | 95 | 86 | 80 | 360 | 826 | 2,400 |
| Comparison-2 | 93 | 80 | 75 | 245 | 610 | 1,820 |
| Comparison-3 | 92 | 73 | 42 | 520 | 1,200 | 3,200 |
| 8 | 100 | 94 | 87 | 233 | 600 | 1,308 |
| Comparison-1 | 100 | 94 | 87 | 310 | 800 | 2,010 |
| Comparison-2 | 95 | 89 | 79 | 242 | 589 | 1,500 |
| Comparison-3 | 92 | 73 | 42 | 520 | 1,200 | 3,200 |
| 9 | 99 | 90 | 83 | 240 | 611 | 1,695 |
| Comparison-1 | 99 | 90 | 83 | 320 | 815 | 2,260 |
| Comparison-2 | 95 | 85 | 74 | 245 | 620 | 1,700 |
| Comparison-3 | 92 | 73 | 42 | 520 | 1,200 | 3,200 |

Comparative samples shown in Table 1-2 were those prepared in the following manner:

Comparative sample-1: This comparative sample was the same as each sample prepared under the conditions shown in Table 1-1, except that the compound of general formula [II] was omitted therefrom.

Comparative sample-2: This comparative sample was the same as each sample prepared under the conditions shown in Table 1-1, except that the compound of general formula [I] was omitted therefrom.

Comparative sample-3: This comparative sample was the same as each sample prepared under the conditions shown in Table 1-1, except that the compounds of both general formulas [I] and [II] were omitted therefrom.

As shown in Table 1-2, it is understood that the present compounds used in combination have dye fading inhibition effect and Y-stain prevention effect, which effects cannot be obtained when the present compounds are used singly.

EXAMPLE 2

The present compounds, yellow couplers and hydroquinone derivatives shown in Table 2-1 were individually dissolved in solvents indicated in said table to prepare solutions. The solutions were individually incorporated with 500 cc of a 5% aqueous gelatin solution containing 3.0 g of sodium dodecylbenzenesulfonate and then dispersed by means of a homogenizer. The dispersions thus obtained were individually incorporated into 1,000 cc of a blue-sensitive silver chloroiodobromide emulsion (containing 1 mole% of silver iodide and 80 mole% of silver bromide). The emulsions were individually incorporated with 10 ml of a 5% methanol solution of triethylenesulfonamide as a film hardener and coated on a polyethylene-coated paper and then dried to obtain light-sensitive silver halide photographic materials (samples Nos. 1–10). These samples were subjected to the same treatment as in Example 1 and then irradiated for 200 hours by means of a Xenon fade-o-meter. The samples were then subjected to measurements in the same manner as in Example 1, except that the residual dye ratio was measured using blue light. The results obtained were as shown in Table 2-2.

TABLE 2-1

| Sample No. | Exemplified coupler and amount added (g) | | Exemplified compound and amount added (g) | | Hydroquinone compound and amount added (g) | | High boiling point solvent and amount used (cc) | | Low boiling point solvent and amount used (cc) | |
|---|---|---|---|---|---|---|---|---|---|---|
| 7 | Y-3 | 61 | (8) | 22 | Hq-1 | 1.22 | DBP | 61 | EA | 120 |
| | | | (39) | 22 | | | | | | |
| 2 | " | " | (13) | 22 | " | " | " | " | " | " |
| | | | (39) | 11 | | | | | | |
| 3 | " | " | (18) | 22 | Hq-13 | 1.22 | " | " | " | " |
| | | | (39) | 22 | | | | | | |
| 4 | Y-5 | 76 | (15) | 23 | " | " | TCP | 76 | " | " |
| | | | (47) | 6.9 | | | | | | |
| 5 | " | " | (19) | 23 | " | " | " | " | " | " |
| | | | (50) | 12 | | | | | | |
| 6 | " | " | (26) | 23 | " | " | " | " | " | " |
| | | | (53) | 9.0 | | | | | | |
| 7 | Y-13 | 77 | (29) | 12 | " | " | DBP | 58 | " | " |
| | | | (9) | 24 | | | TCP | 19 | | |
| 8 | " | " | (29) | 12 | " | " | " | " | " | " |
| | | | (20) | 24 | | | | | | |
| 9 | " | " | (29) | 12 | " | " | " | " | " | " |
| | | | (20) | 6 | | | | | | |
| 10 | " | " | (29) | 12 | " | " | " | " | " | " |
| | | | (20) | 1.2 | | | | | | |

Table 2-2

| Sample No. | | Dye fading ratio (%) | Y-stain increasing ratio (%) |
|---|---|---|---|
| 1 | | 54 | 113 |
| Comparison | -1 | 54 | 135 |
| | -2 | 48 | 125 |
| | -3 | 45 | 163 |
| 2 | | 57 | 131 |
| Comparison | -1 | 57 | 145 |
| | -2 | 49 | 139 |
| | -3 | 45 | 163 |
| 3 | | 56 | 119 |
| Comparison | -1 | 56 | 132 |
| | -2 | 50 | 125 |
| | -3 | 45 | 163 |
| 4 | | 73 | 127 |
| Comparison | -1 | 72 | 140 |
| | -2 | 65 | 135 |
| | -3 | 57 | 165 |
| 5 | | 74 | 129 |
| Comparison | -1 | 74 | 143 |
| | -2 | 67 | 137 |
| | -3 | 57 | 165 |
| 6 | | 75 | 130 |

Table 2-2-continued

| Sample No. | | Dye fading ratio (%) | Y-stain increasing ratio (%) |
|---|---|---|---|
| Comparison | -1 | 75 | 138 |
| | -2 | 65 | 135 |
| | -3 | 57 | 165 |
| 7 | | 76 | 118 |
| Comparison | -1 | 76 | 135 |
| | -2 | 70 | 127 |
| | -3 | 61 | 160 |
| 8 | | 74 | 119 |
| Comparison | -1 | 73 | 137 |
| | -2 | 67 | 125 |
| | -3 | 61 | 160 |
| 9 | | 75 | 121 |
| Comparison | -1 | 74 | 137 |
| | -2 | 70 | 130 |
| | -3 | 61 | 160 |
| 10 | | 72 | 125 |
| Comparison | -1 | 72 | 137 |
| | -2 | 69 | 130 |
| | -3 | 61 | 160 |

From the results shown in Table 2-2, it is understood that the process of the present invention is excellent in fading inhibition effect on dyes formed by means of yellow couplers as well as Y-stain prevention effect.

EXAMPLE 3

The present compounds, cyan couplers and hydroquinone derivatives shown in Table 3-1 were individually dissolved in solvents shown in said table to prepare solutions. The solutions were individually incorporated with 500 cc of a 5% aqueous gelatin solution containing 0.3 g of sodium dodecylbenzenesulfonate and then dispersed by means of a homogenizer. The dispersions thus obtained were individually incorporated into 1,000 cc of a red-sensitive silver chlorobromide emulsion (containing 20 mole% of silver chloride). The emulsions were individually incorporated with 20 ml of a 4% aqueous solution of sodium 2,4-dichloro-6-hydroxy-S-triazine as a film hardener and then coated on a polyethylene-coated paper and dried to obtain light-sensitive silver halide photographic materials (samples Nos. 1-5). The samples were processed in the same manner as in Example 1 and then irradiated for 200 hours by means of a Xenon fade-o-meter and sunlight, respectively.

Table 3-1

| Sample No. | Exemplified coupler and amount added (g) | Exemplified compound and amount added (g) | Hydroquinone compound and amount added (g) | High boiling point solvent and amount used (cc) | Low boiling point solvent and amount used (cc) |
|---|---|---|---|---|---|
| 1 | (C-2) 43 | (1) 13<br>(29) 0.26 | Hq-1 0.30 | DBP 21 | EA 90 |
| 2 | " | (3) 14<br>(29) 0.26 | " | " | " |
| 3 | (C-2) 45 | (1) 12<br>(39) 0.36 | Hq-1 0.34 | " | " |
| 4 | " | (3) 13<br>(39) 1.3 | " | " | " |
| 5 | " | (19) 15<br>(39) 1.3 | " | " | " |

Table 3-2

| Sample No. | | Xenon fad-o-meter (200 hr) Residual dye ratio (%) | Xenon fad-o-meter (200 hr) Y-stain increasing ratio (%) | Sunlight (200 hr) Residual dye ratio (%) | Sunlight (200 hr) Y-stain increasing ratio (%) |
|---|---|---|---|---|---|
| 1 | | 85 | 306 | 89 | 357 |
| Comparison | -1 | 85 | 360 | 89 | 420 |
| | -2 | 85 | 320 | 86 | 375 |
| | -3 | 85 | 430 | 83 | 440 |
| 2 | | 90 | 289 | 90 | 332 |
| Comparison | -1 | 90 | 340 | 90 | 390 |
| | -2 | 87 | 316 | 85 | 362 |
| | -3 | 85 | 430 | 83 | 440 |
| 3 | | 90 | 232 | 90 | 256 |
| Comparison | -1 | 90 | 290 | 88 | 320 |
| | -2 | 88 | 275 | 88 | 285 |
| | -3 | 85 | 325 | 86 | 450 |
| 4 | | 88 | 221 | 90 | 236 |
| Comparison | -1 | 87 | 280 | 88 | 295 |
| | -2 | 86 | 245 | 88 | 265 |
| | -3 | 85 | 325 | 86 | 450 |
| 5 | | 89 | 231 | 92 | 240 |
| Comparison | -1 | 89 | 295 | 87 | 295 |
| | -2 | 85 | 285 | 84 | 280 |
| | -3 | 84 | 330 | 85 | 340 |

Comparative samples in Table 3-2 were the same as those used in Example 1.

From the results shown in Table 3-2, it is understood that the color photographic materials according to the present invention have excellent dye fading ratio and Y-stain prevention effect.

EXAMPLE 4

On the surface of a polyethylene-coated paper support were successively coated under-mentioned layers to prepare a silver halide color photographic material. First layer: A yellow coupler containing blue-sensitive silver halide emulsion was coated on the support so that the amount of silver present in the resulting coated layer became 400 mg/m$^2$. (This emulsion was a silver chloroiodobromide emulsion which contained 1 mole% of silver iodide, 80 mole% of silver bromide and 400 g of gelatin per mole of silver halide, sensitized by the use of a sensitizing dye of the following structure:

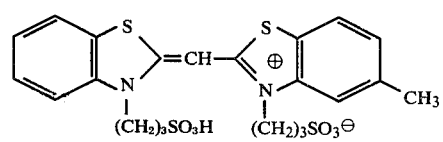

in an amount of $2.5\times10^{-4}$ mole per mole of silver halide, and contained yellow coupler (Y-6) in an amount of $2\times10^{-1}$ mole per mole of silver halide, said coupler having been dissolved and dispersed in dibutyl phthalate. Second layer: This layer was a gelatin layer coated on the first layer so as to have a dye layer thickness of 1μ. Third layer: A magenta coupler containing green-sensitive silver halide emulsion was coated on the second layer so that the amount of silver present in the resulting coated layer became 300 mg/m². (This emulsion was a silver chlorobromide emulsion which contained 80 mole% of silver bromide and 500 g of gelatin per mole of silver halide, sensitized by the use of a sensitizing dye of the following structure:

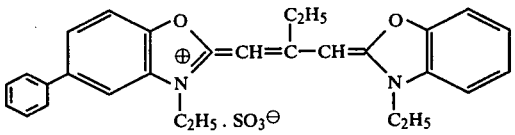

in an amount of $2.5\times10^{-4}$ per mole of silver halide, and contained magenta coupler (M-13) in an amount of $2\times10^{-1}$ mole per mole of silver halide, said coupler having been dissolved and dispersed in a 2:1 mixture of dibutyl phthalate and triscresyl phosphate. Fourth layer: This layer was a gelatin layer having a dry layer thickness of 1μ. Fifth layer: A cyan coupler containing red-sensitive silver halide emulsion was coated on the fourth layer so that the amount of silver present in the resulting coated layer became 500 mg/m². (This emulsion was a silver chlorobromide emulsion which contained 80 mole% of silver bromide and 500 g of gelatin per mole of silver halide, sensitized by the use of a sensitizing dye of the following structure:

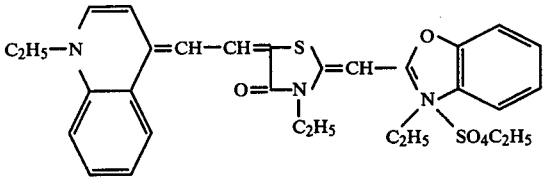

in an amount of $2.5\times10^{-4}$ mole per mole of silver halide, and contained $2\times10^{-1}$ mole of cyan coupler (C-3) per mole of silver halide, said coupler having been dissolved and dispersed in dibutyl phthalate. Sixth layer: This layer was a gelatin layer coated so as to have a dry film thickness of 1μ.

The silver halide emulsions used in the light-sensitive layers (the first, third and fifth layers) were prepared according to the procedure described in Japanese Patent Publication No. 7772/1971, chemically sensitized with sodium thiosulfate pentahydrate, and incorporated with 4-hydroxy-6-methyl-1,3,3a,7-tetrazaindene as a stabilizer, bis(vinylsulfonylmethyl)ether as a film hardener and saponin as a coating aid.

The present compounds, exemplified couplers and hydroquinone derivatives were incorporated into each emulsion layer in the manner as shown in Table 4—1 and dispersed in the same manner as in Example 1.

Table 4-1

| Sample No. | Blue-sensitive emulsion layer | Green-sensitive emulsion layer | Red-sensitive emulsion layer |
|---|---|---|---|
| 1 | 25%, based on the coupler, of exemplified compound (13)<br>20%, based on the exemplified compound (13), of exemplified compound (39)<br>2%, based on the coupler, of hydroquinone derivative Hq-1 | 30%, based on the coupler, of exemplified compound (13)<br>100%, based on the exemplified compound (13), of exemplified compound (39)<br>3%, based on the coupler, of hydroquinone derivative Hq-1 | 15%, based on the coupler, of exemplified compound (13)<br>3%, based on the exemplified compound (13), of exemplified compound (39)<br>0.7%, based on the coupler, of hydroquinone derivative Hq-1 |
| 2 | 30%, based on the coupler, of exemplified compound (3)<br>50%, based on the exemplified compound (3), of exemplified compound (27)<br>2%, based on the coupler, of hydroquinone derivative Hq-3 | 30%, based on the coupler, of exemplified compound (3)<br>50%, based on the exemplified compound (3), of exemplified compound (27)<br>3%, based on the coupler, of hydroquinone derivative Hq-3 | 15%, based on the coupler, of exemplified compound (3)<br>2%, based on the exemplified compound (3), of exemplified compound (27)<br>0.7%, based on the coupler, of hydroquinone derivative Hq-3 |

The samples prepared by the above-mentioned procedure were exposed, according to a sensitomertry method, through optical wedges to blue light, green light and red light, respectively, and then processed in the same manner as in Example 1, except that the stabilization bath treatment was omitted. The processed samples were irradiated for 100 and 200 hours, respectively, by means of a Xenon fade-o-meter and then measured according to the procedure described in Example 1 in dye density and Y-stain after irradiation to obtain the results as shown in Table 4-2.

Table 4 - 2

| Sample No. | Irradiation time | Residual dye ratio (%) Yellow 100 | Yellow 200 | Magenta 100 | Magenta 200 | Cyan 100 | Cyan 200 | Y-stain increasing ratio (%) 100 | 200 |
|---|---|---|---|---|---|---|---|---|---|
| 1 | | 95 | 85 | 95 | 80 | 97 | 85 | 315 | 420 |
| Comparison | -1 | 95 | 85 | 90 | 75 | 96 | 85 | 450 | 600 |
| | -2 | 93 | 82 | 85 | 67 | 95 | 84 | 370 | 490 |
| | -3 | 91 | 80 | 73 | 55 | 93 | 80 | 460 | 700 |
| 2 | | 95 | 86 | 98 | 83 | 99 | 88 | 352 | 502 |
| Comparison | -1 | 95 | 86 | 92 | 76 | 98 | 87 | 470 | 670 |
| | -2 | 94 | 83 | 85 | 65 | 95 | 83 | 372 | 523 |
| | -3 | 91 | 80 | 73 | 55 | 93 | 80 | 460 | 700 |

The comparative samples shown in Table 4-2 have the same meaning as in Example 1.

From the results shown in Table 4-2, it is understood that the color photographic materials according to the present invention have an excellent fading inhibition effect and a Y-stain prevention effect.

EXAMPLE 5

A solution of 14.5 g of exemplified compound [15] and 8 g of exemplified compound [40] in a mixture of 15 cc of dibutyl phthalate and 30 g of ethyl acetate was incorporated into 120 cc of a 5% aqueous gelatin solution containing sodium dodecylbenzenesulfonate and then dispersed by means of a homogenizer. The dispersion thus obtained was incorporated into 300 cc of a green-sensitive silver chlorobromide emulsion (containing 30 mole% of silver chloride), and the resulting emulsion was coated on a polyethylene-coated paper to obtain a silver halide photographic material.

The silver halide photographic material thus obtained was exposed, according to a sensitometry method, to light through optical wedges and then processed at 24° C. according to the following order.

| Treatment step | |
|---|---|
| First development | 5 min. |
| Water-washing | 4 min. |
| Exposure | |
| Color development | 3 min. |
| Water-washing | 4 min. |
| Bleaching | 4 min. |
| Fixing | 4 min. |
| Water-washing | 10 min. |

The first developer, color developer, bleaching solution and fixing solution used were those having their respective compositions as mentioned below.

| First developer composition | |
|---|---|
| Anhydrous sodium bisulfite | 8.0 g |
| Phenidon | 0.35 g |
| Anhydrous sodium sulfite | 37.0 g |
| Hydroquinone | 5.5 g |
| Anhydrous sodium carbonate | 28.2 g |
| Sodium thiocyanate | 1.38 g |
| Anhydrous sodium bromide | 1.30 g |
| Potassium iodide (0.1% aqueous solution) | 13.0 ml |
| Water to make 1 liter (pH 9.9) | |
| Color developer composition: | |
| Anhydrous sodium sulfite | 10.0 g |
| N,N-Diethyl-p-phenylenediamine hydrochloride | 3.0 g |
| Magenta coupler (M-19) | 2.0 g |
| Water to make 1 liter | |
| Adjusted to pH 11.5 with sodium hydroxide. | |
| Bleaching solution composition: | |
| Anhydrous sodium bromide | 43.0 g |
| Potassium ferricyanide | 165.0 g |
| Borax ($Na_2B_4O_7$ 10 $H_2O$) | 1.2 g |
| Water to make 1 liter. | |
| Fixing solution composition: | |
| Sodium thiosulfate (pentahydrate) | 200 g |
| Anhydrous sodium sulfate | 100 g |
| Anhydrous disodium phosphate | 15.0 g |
| Water to make 1 liter. | |

The color photographic material (test sample) was measured as to dye fading ratio and Y-stain increasing ratio of unexposed area in the same procedure as in Example 1, except that the sample was irradiated for 200 hours by means of a Xenon fade-o-meter to obtain the results as shown in Table 5-1.

Table 5 - 1

| | | Residual dye ratio (%) | Y-stain increasing ratio (%) |
|---|---|---|---|
| Test sample | | 82 | 121 |
| Comparative sample | -1 | 80 | 155 |
| | -2 | 71 | 145 |
| | -3 | 51 | 530 |

The comparative samples shown in Table 5-1 were the same meanings as in the comparative samples prepared and used in Example 1.

From Table 5-1, it is understood that the present compounds have an excellent fading inhibition effect and a Y-stain prevention effect even when used in the so-called external type silver halide color photographic material containing no coupler.

What is claimed is:

1. A color photosensitive material comprising a support and a silver halide photosensitive layer which material comprises a compound represented by the following formula (I)

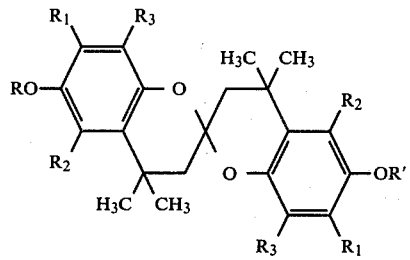

Formula (I)

wherein $R_1$ is an alkyl group, an alkenyl group, an aryl group, an alkoxy group, an alkenoxy group or an aryloxy group; $R_2$ and $R_3$ are individually hydrogen, halogen, or an alkyl group, an alkenyl group or an alkoxy group; R is an alkyl group, an alkenyl group, a cycloalkyl group, an aryl group or a member selected from the group consisting of imidazolyl, furyl, pyridyl, and thiazolyl, or $R_6CO$—, $R_7SO_2$— or $R_8NHCO$—; and R' is hydrogen, or $R_6CO$—, $R_7SO_2$— or $R_8NHCO$— wherein $R_6$, $R_7$ and $R_8$ are individually an alkyl group, an alkenyl group, a cycloalkyl group, an aryl group or a member selected from the group consisting of imidazolyl, furyl, pyridyl, and thiazolyl, in combination with a compound represented by the following formula (II).

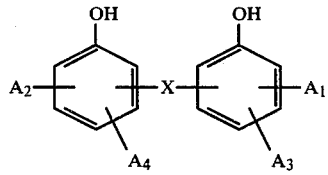

Formula (II)

wherein $A_1$, $A_2$, $A_3$ and $A_4$ are individually an alkyl group having 1–18 carbon atoms, the total number of carbon atoms of $A_1$, $A_2$, $A_3$ and $A_4$ being not more than 32; and X is a simple bond, oxygen, sulfur, sulfonyl or

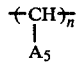

in which $A_5$ is hydrogen or an alkyl group having 1–10 carbon atoms and n is an integer of 1 to 3.

2. A color photosensitive material comprising a support, a cyan coupler-containing red-sensitive silver halide photosensitive emulsion layer, a magenta coupler-containing green-sensitive silver halide photosensitive emulsion layer, and a yellow coupler-containing blue-sensitive silver halide photosensitive emulsion layer, said material comprising a compound represented by the following formula (I)

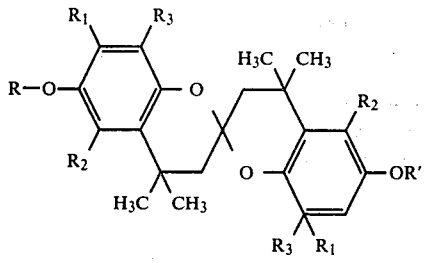

Formula (I)

wherein $R_1$ is an alkyl group, an alkenyl group, an aryl group, an alkoxy group, an alkenoxy group or an aryloxy group; $R_2$ and $R_3$ are individually hydrogen, halogen, or an alkyl group, an alkenyl group or an alkoxy group, R is an alkyl group, an alkenyl group, a cycloalkyl group, an aryl group or a member selected from the group consisting of imidazolyl, furyl, pyridyl, thiazolyl, or $R_6CO$—, $R_7SO_2$— or $R_8NHCO$—; and R' is hydrogen, or $R_6CO$—, $R_7SO_2$— or $R_8NHCO$— wherein $R_6$, $R_7$ and $R_8$ are individually an alkyl group, an alkenyl group, a cycloalkyl group, an aryl group, or a member selected from the group consisting of imidazolyl, furyl, pyridyl, and thiazolyl, in combination with a compound represented by the following formula (II)

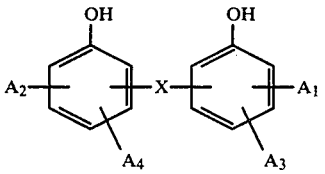

Formula (II)

wherein $A_1$, $A_2$, $A_3$ and $A_4$ are individually an alkyl group having 1-18 carbon atoms, the total number of carbon atoms of $A_1$, $A_2$, $A_3$ and $A_4$ being not more than 32; and X is a simple bond, oxygen, sulfur, sulfonyl or

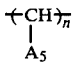

in which $A_5$ is hydrogen or an alkyl group having 1-10 carbon atoms and n is an integer of 1 to 3.

3. A color photosensitive material according to claim 1 wherein the photosensitive layer comprises the compound of formula [I] in combination with the compound of formula [II].

4. A color photosensitive material according to claim 1 wherein $R_1$ is an alkyl group, an alkenyl group or an aryl group.

5. A color photosensitive material according to claim 1 wherein $R_2$ and $R_3$ are individually hydrogen or an alkyl group.

6. A color photosensitive material according to claim 1 wherein R is an alkyl group, an alkenyl group, a cycloalkyl group, or $R_6CO$—, $R_7SO_2$— or $R_8NHCO$—.

7. A color photosensitive material according to claim 4 wherein $R_1$ is an alkyl group or an aryl group.

8. A color photosensitive material according to claim 5 wherein $R_2$ and $R_3$ are individually hydrogen.

9. A color photosensitive material according to claim 6 wherein $R_6$, $R_7$ and $R_8$ are individually an alkyl group or an aryl group.

10. A color photosensitive material according to claim 1 wherein the compound of formula [II] is represented by the following formula:

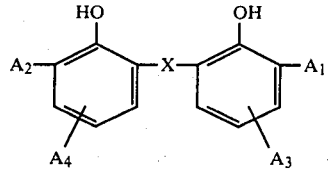

Formula (IIa)

or

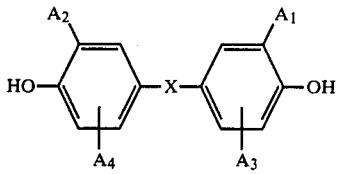

Formula (IIb)

11. A color photosensitive material according to claim 10 wherein $A_1$ and $A_2$ are individually tertiary alkyl.

12. A color photosensitive material according to claim 2 wherein at least one of the three emulsion layers comprises the compound represented by the formula [I] in combination with the compound represented by the formula [II].

13. A color photosensitive material according to claim 12 wherein the magenta coupler-containing silver halide photosensitive emulsion layer comprises the compound represented by the formula [I] in combination with the compound represented by the formula [II].

14. A color photosensitive material according to claim 13 wherein $R_1$ is an alkyl group, an alkenyl group or an aryl group.

15. A color photosensitive material according to claim 13 wherein $R_2$ and $R_3$ are individually hydrogen or an alkyl group.

16. A color photosensitive mateirial according to claim 13 wherein R is an alkyl group, an alkenyl group, a cycloalkyl group, or $R_6CO$—, $R_7SO_2$— or $R_8NHCO$—.

17. A color photosensitive material according to claim 14 wherein $R_1$ is an alkyl group or an aryl group.

18. A color photosensitive material according to claim 15 wherein $R_2$ and $R_3$ are individually hydrogen.

19. A color photosensitive material according to claim 16 wherein $R_6$, $R_7$ and $R_8$ are individually an alkyl group or an aryl group.

20. A color photosensitive material according to claim 13 wherein the compound of formula [II] is represented by the following formula [IIa] or [IIb].

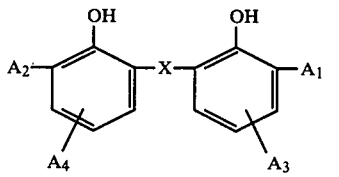

Formula (IIa)

or

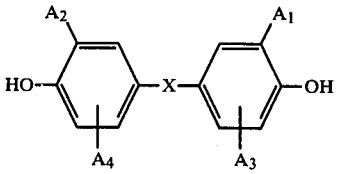

Formula (IIb)

21. A color photosensitive material according to claim 20 wherein $A_1$ and $A_2$ are individually tertiary alkyl.

* * * * *